US009991628B2

(12) United States Patent
Daoura

(10) Patent No.: US 9,991,628 B2
(45) **Date of Patent: *Jun. 5, 2018**

(54) QUICK CONNECT MAGNETIC INTERFACE PRODUCTS AND METHODS

(71) Applicant: Daniel J Daoura, Renton, WA (US)

(72) Inventor: Daniel J Daoura, Renton, WA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/337,357

(22) Filed: Oct. 28, 2016

(65) Prior Publication Data

US 2017/0062974 A1 Mar. 2, 2017

Related U.S. Application Data

(63) Continuation-in-part of application No. 14/805,277, filed on Jul. 21, 2015, now Pat. No. 9,515,420.

(60) Provisional application No. 62/027,184, filed on Jul. 21, 2014.

(51) Int. Cl.

| | |
|---|---|
| ***H01R 11/30*** | (2006.01) |
| ***H01R 13/62*** | (2006.01) |
| ***H01R 13/64*** | (2006.01) |
| *H01R 24/60* | (2011.01) |
| *H01R 31/06* | (2006.01) |

(52) U.S. Cl.

CPC ..... *H01R 13/6205* (2013.01); *H01R 13/64* (2013.01); *H01R 24/60* (2013.01); *H01R 31/065* (2013.01)

(58) Field of Classification Search

CPC ..... H01R 13/6205; H01R 4/34; H01R 27/00; H01R 31/06; H01R 2103/00

USPC ..... 439/38–40, 217, 218, 638, 675

See application file for complete search history.

(56) References Cited

U.S. PATENT DOCUMENTS

| | | | | |
|---|---|---|---|---|
| 3,363,214 | A * | 1/1968 | Wright | H01R 13/6205 439/180 |
| 5,784,511 | A | 7/1998 | Kikuchi | |
| 5,812,356 | A | 9/1998 | Liu | |
| 5,921,783 | A * | 7/1999 | Fritsch | H01R 13/703 439/38 |
| 7,311,526 | B2 | 12/2007 | Rohrbach | |
| 7,351,066 | B2 | 4/2008 | Difonzo | |
| 7,354,315 | B2 | 4/2008 | Goetz | |
| 7,458,825 | B2 | 12/2008 | Atsumon | |

(Continued)

*Primary Examiner* — Thanh Tam Le

(74) *Attorney, Agent, or Firm* — Kal K Lambert; Lambert Patent Services LLC

(57) ABSTRACT

A quick-connect adaptor for conveying data or data and power from a first electronic unit to a second electronic unit. The adaptor includes a connectable interface between a first body part and a second body part, wherein the parts may be coupled with rotationally symmetry such that a 180 degree rotation of either body part, either clockwise or counter-clockwise, results in an identical electrical connection, eliminating the need for checking alignment when making a connection. The first and second body parts in either of two rotational orientations are secured together by a magnetic "snap" connection. Three-piece and two-piece kits are disclosed for coupling with popular devices. In an optional embodiment, at least one end of the interface includes a "smart sensor" and a processor or logic gates that configure communications so as to be correctly wired in either rotational orientation, even before an electrical connection is made.

19 Claims, 25 Drawing Sheets

(56) References Cited

U.S. PATENT DOCUMENTS

| | | | | |
|---|---|---|---|---|
| 7,658,613 | B1 * | 2/2010 | Griffin | H01R 13/6205 439/39 |
| 7,874,844 | B1 | 1/2011 | Fitts | |
| 8,073,324 | B2 | 12/2011 | Tsai | |
| 8,138,869 | B1 | 3/2012 | Lauder et al. | |
| 8,242,868 | B2 | 8/2012 | Lauder et al. | |
| 8,461,465 | B2 | 6/2013 | Golko | |
| 8,514,042 | B2 | 8/2013 | Lauder et al. | |
| 8,517,751 | B1 | 8/2013 | Golko | |
| 8,517,766 | B2 | 8/2013 | Golko | |
| 8,535,075 | B1 | 9/2013 | Golko et al. | |
| 8,535,088 | B2 * | 9/2013 | Gao | H01R 9/03 439/39 |
| 8,790,120 | B2 * | 7/2014 | Wang | H01R 13/6205 439/39 |
| 8,936,472 | B1 * | 1/2015 | Gibboney, Jr. | H01R 13/64 439/39 |
| 9,300,081 | B2 * | 3/2016 | Rudisill | H01R 13/6205 |
| 9,362,664 | B2 * | 6/2016 | Yen | H01R 13/6205 |
| 9,515,420 | B2 * | 12/2016 | Daoura | H01R 13/6205 |
| 2004/0209489 | A1 | 10/2004 | Clapper | |
| 2013/0095701 | A1 | 4/2013 | Golko | |

* cited by examiner

USB PORT

USB PORT CONFIGURATIONS

| Pin | Signal | Color | Description |
|---|---|---|---|
| 1 | VCC | RED | +5V |
| 2 | D- | WHITE | Data - |
| 3 | D+ | GREEN | Data + |
| 4 | GND | BLACK | Ground |

Fig. 4A
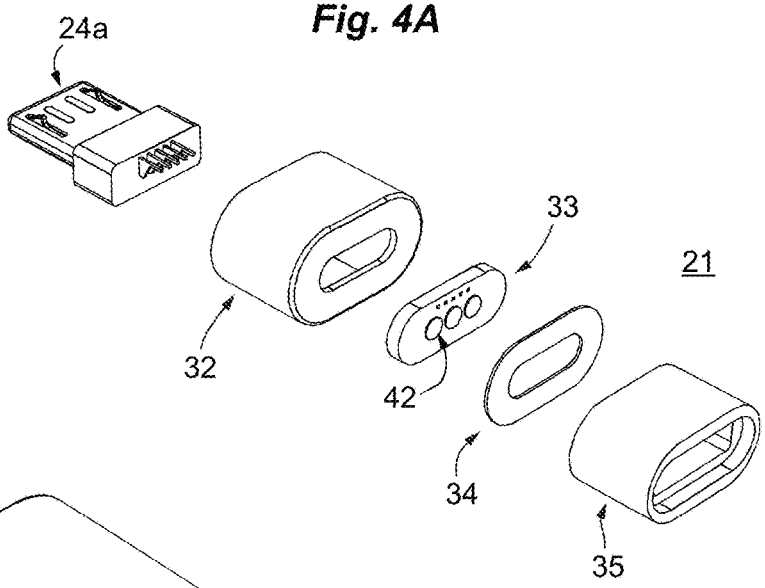
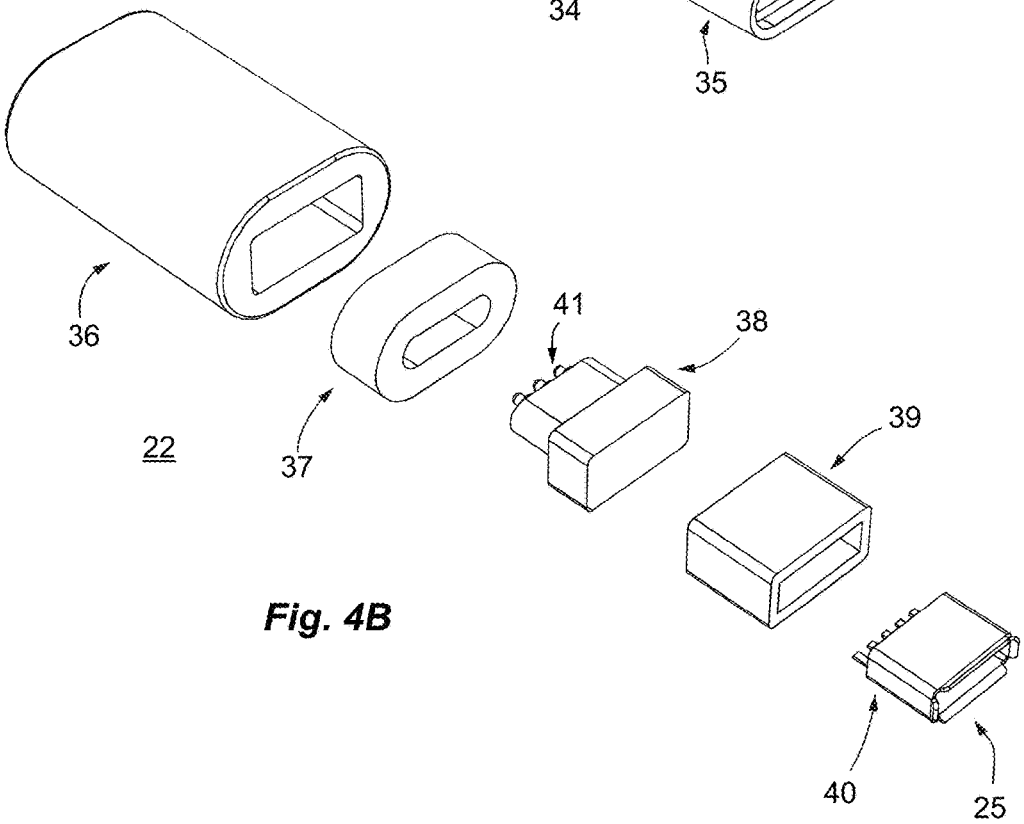
Fig. 4B

ANDROID-Type iOS-Type

QUICK CONNECT MAGNETIC INTERFACE PRODUCTS AND METHODS

CROSS REFERENCE TO RELATED APPLICATIONS

This application is a continuation-in-part of U.S. patent application Ser. No. 14/805,277, filed 21 Jul. 2015, which claims the benefit of priority under 35 U.S.C. § 119(e) from U.S. Provisional Patent Application No. 62/027,184 filed Jul. 21, 2014; said patent documents being incorporated herein in entirety for all purposes by reference.

GOVERNMENT SUPPORT

Not Applicable.

FIELD OF THE INVENTION

This application relates to an electrical interface having a magnetic coupling. More particularly, the present invention relates to an electrical interface with "snap-in-place" toroidal magnetic coupling and two rotational orientations having circuit equivalence for interchangeably connectable electronics.

BACKGROUND

Electronic modules, termed here generically as "devices", including for example computers and peripherals, cell phones, cameras, memory sticks, and other electronics that share power and/or data over one or more interface, typically have a separate connector for each interface. The connectors are "keyed" by their form factor so that each "plug" connector may be inserted into one and only one "species" of "receptacle". This requires the user to ensure that the connectors are properly oriented and mated before insertion; at risk otherwise of damaging the connector or connector port.

Many electronic communication and power interfaces exist. Devices communicate using, for example, parallel, serial, PS/2, Universal Serial Bus (USB), and FireWire data interfaces. Recent introductions include proprietary interfaces such as LIGHTNING® (Apple, Cupertino Calif.) and THUNDERBOLT® (Intel, Santa Clara, Calif.). USB is a more generally recognized universal standard for charging and data exchange, and is available in three generations: 1.0, 2.0 and 3.0 for increased power sharing, resistance to interference, and speed.

Typically the connectors include a male part of the connector that seats in a female I/O port in the device. The female part is typically mounted at an edge of a circuit board. The number of pins and leads in the connector harness varies and may be between 3 and 30, for example, without limitation thereto. The roles of male and female may be interchanged if desired, but a combination of a male connector and a female receptacle is typical.

Usability and durability are significant problems with all such interfaces. USB connectors, for example, are rated for only 1500 cycles of insertion and deletion. USB 3.0 was developed to increase bandwidth and power capacity to up to 1 Amp, and THUNDERBOLT was developed with a speed of 128 GB/sec. Mini-USB was developed with trapezoidal body that helps in "keying" orientation of power and ground and has folded lateral walls for increased rigidity. All such connectors have been widely criticized for their capacity to collect foreign matter. Orientation is also problematic; as the connectors become smaller, difficulty in correctly aligning the connector increases. A micro-USB port connector is also available. Thus the field continues to evolve.

Interfaces having magnetic arrays are disclosed for example in U.S. Pat. No. 5,784,577 to SONY, U.S. Pat. No. 7,311,526 to APPLE, and U.S. Pat. No. 7,354,315 to Goetz. US Pat. Appl. No. 2004/0209489 to INTEL sought to use a magnetic coupling in a docking device. Also illustrative is U.S. Pat. No. 7,874,844 to Fitt, the interface having a three-piece power coupling. These magnetic interfacial couplings have pads instead of pins, and have been promoted because they are more sanitary than pin connectors. They also have a lower profile, permitting reduced device dimensions. However, the technology is not yet widely used and is most commonly seen in dedicated devices based on proprietary couplings that are operative only when installed in one prescribed orientation in a corresponding proprietary device.

A need remains therefor for interfaces that are interoperable in connecting one device to another, so that users are not compelled to rely on keying of the interface connector to ensure that pins or pads are lined up correctly. Bi-rotational interfaces are desired that are smart in mating up correctly in either of two orientations (i.e., when flipped) so as to automatically prevent damage caused by forcing an incorrect orientation of the connector parts.

SUMMARY

The invention includes quick connect magnetic couplings for making an electrical connection, where the connector interface is configured to facilitate charging of a device such as a phone, tablet, camera, recorder, player, or other mobile electronics and sharing of data. These quick connect magnetic interface embodiments are advantageous in data synchronization and sharing, such as for connecting interchangeably connectable electronics, including memory sticks, computers, cell phones, laptops, DVD players, recorders, IoT devices, and cameras, while not limited thereto. Methods of use are also disclosed.

In a first embodiment, the invention is a quick connect coupling for conveying data and power or data to or from a first electronic module (a mobile or guest device) to a second electronic module (a host). The adaptor includes an interface between a first body part and a second body part. The interface is established by magnetically coupling the parts face to face. The body parts may be coupled "bi-rotationally," i.e., in either a right-handed or left-handed rotation relative to a long axis of the body parts, thereby eliminating the need for checking the relative orientation of the connector parts. Orientation of power and data interconnections are not dictated by form factor of the body parts, but instead a magnetic coupling secures the first and second body parts so that the interface is smoothly mated and disengaged with a gently tug. Advantageously, bevels in the coupling assist in seating the interface in either of two equivalent orientations. The coupling is configured so that the connection is symmetrical and may be made quickly, without regard to right or left, top or bottom, or the handedness of the connector. The magnetic interface assembly is sleek and small and allows the user to quickly and conveniently communicate with and charge their device without having to use a dedicated charging cable.

The quick-connect magnetic interface assembly plugs into a device through a USB port, or 30-pin connector, or USB-miniport on most Android® and windows phones/tablets and through a 30-Pin (4G) connector or LIGHTNING® (5G) connector on most iOS APPLE® devices. To begin charging, the user would place the device near a magnetic receptacle (female counterpart) and mate it with a tap to the "male" interface already plugged into the device. Typically an LED lights up to indicate that the data and power circuitry is correctly mated and functional.

The invention may include complementary first and second body parts that engage each other magnetically, snapping together. The second body part includes an interface that is structured with miniature pins or pads that are spring-loaded to allow for a quick connection to corresponding pads or pins on the first body part interface through the pull force of a permanent magnetic component in the second body part that attracts a paramagnetic element within the first body part. Magnetic force pulls both body parts together while allowing interconnected devices to charge and exchange data. Disconnecting two devices is easy as pulling one device away from the other so as to break the magnetic field. The I/O plug on the first body part stays plugged into the device after the magnetic connection is broken so that a connection can be readily reestablished. This invention can be used for both power and data transfer through the two-piece or three-piece quick connect magnetic interface assemblies disclosed here. The magnetic element is a toroid, and by using a mating paramagnetic element, the magnetic coupling is stabilized and self-aligning. By toroid, reference is made to a solid formed by rotating a closed curve around a line that lies in the same plane as the curve but does not intersect it. A toroid having a circular closed curve resembles a donut and is a subtype of toroid termed a "ring torus". Other toroid subtypes include "horn toroid" and "spindle toroid", "elliptical melanoid", an "elliptical axoid", or an "elliptical ring toroid", while not limited thereto.

The interfacial connection is bi-rotational, which means the body parts of the magnetic interface assembly can mate with either side facing down. There is no directionality as to how the "plug-in" interface connects to the second body part interface, which simplifies the action of synching, charging or hot swapping your devices without having to know the orientation of the charging plug. This is particularly a benefit to USB interfaces insofar as they are currently keyed and can only be aligned for insertion in a certain direction. A common user experience is the frustration of determining the correct orientation and inserting the connector properly so as to not cause damage or data loss. This problem is especially apparent in increasingly miniaturized "mini" connectors.

In a preferred embodiment, the quick connect coupling includes a first electrical interface surface mounted in a first body part and a second electrical interface surface mounted in a second body part, such that the interface surfaces have mating surfaces and mating electrical connectors configured to establish a patent electrical connection therebetween, the interface surfaces further having a common long axis of rotation perpendicular to said interface surfaces, wherein the electrical connection is equivalent in a first and a second rotational orientation of the two body parts. The first rotational orientation and the second rotational orientation are defined by a 180 degree rotation of the body parts on the long axis of the connector.

In other embodiments, the invention may be configured as a docking station having integral interface connectors such that the first or second body parts are integrated into a guest device so as to facilitate connecting when the guest device is mounted in the docking station having a corresponding magnetic interconnect. In yet other embodiments, two electronic modules are joined by an interface connector of the invention, where at least one electronic module includes a Hall Effect sensor for detecting the polarity of the magnetic coupling during docking and configures a circuit for transceiving data (and/or power) before the connection is made. THUNDERBOLT®, USB, and LIGHTNING® quick connectors as herein improved to have a proximity-directed bi-rotationally connectable magnetic coupling are particularly preferred as embodiments of the invention.

The elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIG. 3A shows a first "plug-in" body part and FIG. 3B shows a second body part.

FIGS. 4A and 4B are exploded views of the quick connect USB magnetic interface assembly of FIG. 2A; where FIG. 4A shows a first body part with plug-in micro-USB connector and FIG. 3B shows a second body part configured at a proximate end for receiving a micro-USB cable.

FIG. 12D is a detail view of a distal end and shows a receiving port for a cable with male THUNDERBOLT® plug-in.

FIGS. 16A through 16E show the steps of a method for installing (dashed arrows) a quick coupling magnetic interface assembly of the invention.

Figure 1A:
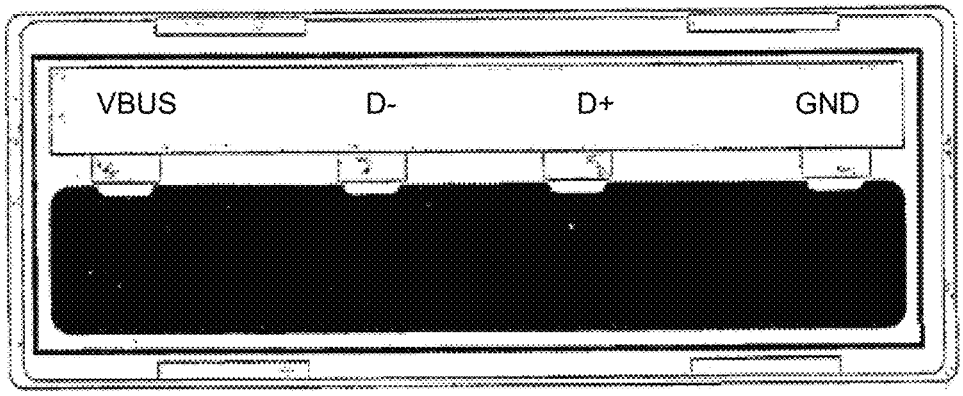
Fig. 1A (PRIOR ART)
FIG. 1A is drawn to illustrate a 4-pin USB connector of the prior art.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

GLOSSARY

Certain terms are used throughout the following description to refer to particular features, steps or components, and are used as terms of description and not of limitation. As one skilled in the art will appreciate, different persons may refer to the same feature, step or component by different names. Components, steps or features that differ in name but not in structure, function or action are considered equivalent and not distinguishable, and may be substituted herein without departure from the invention. Certain meanings are defined here as intended by the inventors, i.e., they are intrinsic meanings. Other words and phrases used herein take their meaning as consistent with usage as would be apparent to one skilled in the relevant arts. The following definitions supplement those set forth elsewhere in this specification.

Unless otherwise defined, all technical and scientific terms used herein have the same meaning as commonly understood by one of ordinary skill in the art to which this invention belongs. In case of conflict, the present specification, including definitions, will control.

"USB" is an acronym for "Universal Serial Bus", which has been become the most-used standard for wired connection of peripherals to computer motherboards and more recently for connecting peripherals to cellphones and IoT devices. Although the invention will be described with particular reference to the USB standard, it is to be understood that the principles of the invention are equally applicable to other standards and particularly to connectors having different contact arrangements or form factors than the USB standard. These include for example the LIGHTNING® connector, the THUNDERBOLT® connector, and various mini- and micro-variants, including parallel bus connectors. It is therefore to be understood that the invention both as described and as claimed is not intended to be limited to any specific standard and the more generic term "interchangeably connectable electronics" abbreviated as "ICE" will be used to denote any interface standard for allowing devices to be interconnected. Because the USB standard calls for a power supply line with a voltage of 4.35V to 5.25V, a higher voltage would indicate a USB interface and a lower voltage, for example below 3V, would indicate a low-voltage serial interface.

A USB connector replaces different kinds of serial and parallel port connectors with a standardized plug and port connection. For the successful implementation of a USB connector, the processor must have an operating system that is USB compliant and that understands it. This permits hot swapping to be done without the need to shut down and reboot the system each time a peripheral device is attached or removed from the processor. The processor automatically detects the peripheral device and configures the necessary software. The USB standard allows several peripheral devices to be connected at the same time. Many processors have more than one USB port, and some peripheral devices called USB hubs have additional ports to allow several peripherals to be cascaded or "daisy chained" together. The USB controller senses that a peripheral requires power (or data) and delivers the power (or data) to the peripheral. USB Implementers Forum (USB-IF) specifications use the term "USB" to refer to slower speeds of 12 Mbps and 1.5 Mbps for peripherals, such as joysticks, keyboards and mice, and the term "Hi-speed USB" for high speeds of 480 Mbps useful with most other devices, such as digital cameras and CD-ROM burners.

Two different types of USB connectors are in common use. One is a type "A" connector, and uses a receptacle that contains four pins in a straight line on one side of a connector plate. Pin #1 is for power and pin #4 is the ground connection while pins #2 and 3 are for the output and input of data, respectively. Another is a type "B" connector, comprising two pins on either side of the receptacle connector plate. The present invention is principally concerned with an improvement in connectors of the "A" type. USB ports are also described by generation, from 1.0 currently to 3.0. Other power and data ports are known in the art, for example LIGHTNING® and THUNDERBOLT®. THUNDERBOLT is a communications port capable of operating at 128 GHz and is not compatible with USB, but has found use on proprietary external memory devices such as "memory sticks" and Android devices.

General connection terms including, but not limited to "connected," "attached," "conjoined," "secured," and "affixed" are not meant to be limiting, such that structures so "associated" may have more than one way of being associated. "Electrically connected" indicates a connection for conveying power, digital signals, and/or analog signals therethrough.

"Processor" refers to a digital device that accepts information in digital form and manipulates it for a specific result based on a sequence of programmed instructions. Processors are used as parts of digital circuits generally including a clock, random access memory and non-volatile memory (containing programming instructions), and may interface with other digital devices or with analog devices through I/O ports such as USB ports, for example.

"Right handed orientation" and "left handed orientation" refer to an interface having two configurations such the connection may be made in either of two orientations. This is achieved by configuring the interface with a mirror axis of symmetry of the connections and by use of redundant electrical connections. Because these interface connectors typically have an extended aspect ratio, the most common orientations are "upside-up" and "downside-up". The upside of a USB connector is sometimes difficult to distinguish, and micro-USB ports have a form factor that prevents downside-up insertion. Insertion in an inverted position could result in a short from the $V_{BUS}$ to GRD and these pins are typically placed contralaterally in the body of the connector. $V_{BUS}$ is also sometimes termed VCC or V+. A connector that is insensitive to orientation is a right or left-handed orientation is a "bi-rotationally-connectable interface." More particularly, the body parts of a magnetic interface connector can be flipped "right side up" or "right side down" while forming an equivalent circuit when engaged.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. The various components, features, steps, or embodiments thereof are all "preferred" whether or not it is specifically indicated. Claims not including a specific limitation should not be construed to include that limitation. The term "a" or "an" as used in the claims does not exclude a plurality.

"Conventional" refers to a term or method designating that which is known and commonly understood in the technology to which this invention relates.

"Adapted to" includes and encompasses the meanings of "capable of" and additionally, "designed to", as applies to those uses intended by the patent. In contrast, a claim drafted with the limitation "capable of" also encompasses unintended uses and misuses of a functional element beyond those uses indicated in the disclosure. Aspex Eyewear v Marchon Eyewear 672 F3d 1335, 1349 (Fed Circ 2012). "Configured to", as used here, is taken to indicate is able to, is designed to, and is intended to function in support of the inventive structures, and is thus more stringent than "enabled to".

Unless the context requires otherwise, throughout the specification and claims that follow, the term "comprise" and variations thereof, such as, "comprises" and "comprising" are to be construed in an open, inclusive sense—as in "including, but not limited to."

The appended claims are not to be interpreted as including means-plus-function limitations, unless a given claim explicitly evokes the means-plus-function clause of 35 USC § 112 para (f) by using the phrase "means for" followed by a verb in gerund form.

A "method" as disclosed herein refers to one or more steps or actions for achieving the described end. Unless a specific order of steps or actions is required for proper operation of the embodiment, the order and/or use of specific steps and/or actions may be modified without departing from the scope of the present invention.

DETAILED DESCRIPTION

Figure 1B:
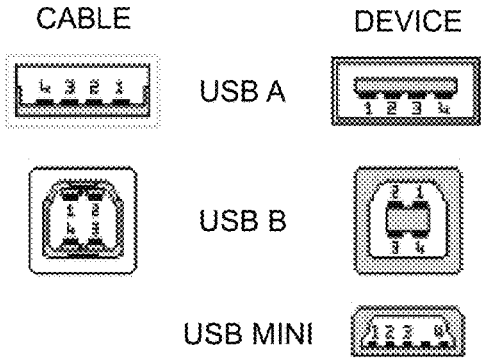
Fig. 1B (PRIOR ART)
FIG. 1B shows alternate configurations, including a USB port for receiving a male USB cable end connector.

FIG. 1A is drawn to illustrate a 4-pin USB connector of the prior art. FIG. 1B shows alternate configurations, including a micro-USB port for receiving a male USB cable end connector. FIG. 1A is not drawn to scale but illustrates pin layout. A current supply ($V_{BUS}$) is rated for 3.6 to 5 VDC and is placed in the connector as far from ground (GND) as possible. The two middle pins (D+, D−) are for differential signals such as a 5 mV square wave for bi-rotational serial data exchange. Data transfer is supported by an on-board communications chip that has a speed of 1.5 to 480 Mbps, depending on the generation.

Standard USB 1.0 and 2.0 connectors are rectangular, but include internal fiducials that allow insertion in only one orientation. The difficulty of guessing the correct orientation is compounded when the receptacle is not easily accessible, such as is often the case because many USB ports are accessed on the rear of a computer. Mini-USB ports have been advance to solve this problem and have trapezoidal form factor that prevents wrong insertion, but a bi-rotationally-connectable interface is not enabled by these methods and again, the receptacle may not be readily inspected to determine the correct orientation of the connector. Similar problems are noted on cellphone chargers, where even micro-USB connectors with a stereospecific body form can be seen to initially engage the receptacle in the wrong orientation, and then must be reversed for proper insertion. This leads to wear on the connector and the J-plug or edge pins on the internal circuit board, and is frustrating to users.

The drawings of prior art connectors are shown to demonstrate the following problems: A. The current mini-USB standard does not readily permit further miniaturization in thickness or length of the male connector. Current state of the art (generation 3.0) connectors typically can support up to 8 pins, and rely on a simple duplication of the data wire harness to achieve greater amperage throughput and bandwidth. Legacy connectors support only 3, 4 or 5 pins. B. Legacy first and second generation USB male connectors are generally rectangular, making difficult the correct fitting of the connector into a receptacle except by trial and error. C. The USB standard is problematic when inserting multiple devices into a bank of USB connectors, simply due to physical interference from other devices already installed. USB extension hubs are required to solve this problem. D. The length of the connector and its stiffness results in transfer of loads onto the receptacle housing, causing the receptacle to be vulnerable to failure. The length is also problematic for the designer and the user, because clearances are required around the connector and inside the device, limiting miniaturization and causing clutter in the workspace around the device.

Figure 2A:
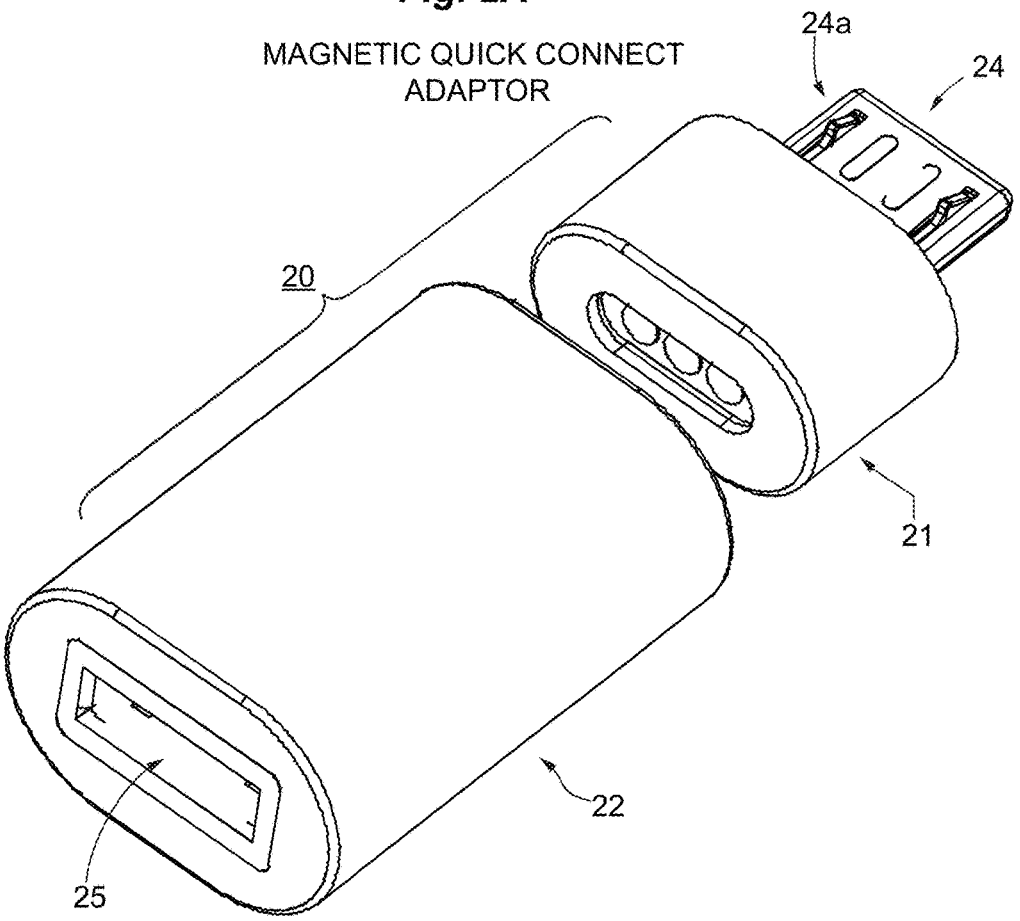
FIGS. 2A and 2B are views of a magnetic quick connect coupling of the invention having a male mini-USB connector on a proximate end (top, right) and configured for receiving a USB male connector on a second end.

FIG. 2A is a first view of a magnetic quick connect adaptor 20 of the invention having two body parts (labelled here "first plug-in body part" 21 or "first body part" and "second body part" 22). The second body part is formed as a sleeve into which the first body part inserts when making a connection. For purposes of explanation, any end that points/connects to or inserts into a mobile or guest electronic device is termed a "proximal connector end" 24 and an end for receiving a cable from a host device or pointing in the direction of the cable connection, is termed here the "distal connector end" 25. Here the distal connector end includes a standard USB port and the proximal connector end is defined by an insertable plug-in mini-connector 24*a*.

The proximal end terminates in a plug-in connector 24*a* that is seated into a compatible I/O or power port on a "mobile" or "guest" device. The distal end 25 terminates in a standard USB receptacle for receiving a charging cable in this example.

Figure 2B:
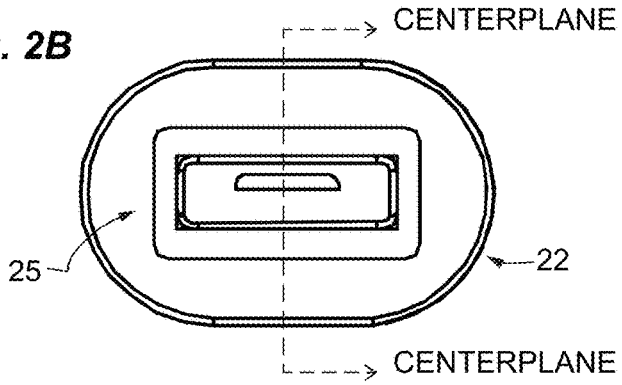

The connector is a bi-rotationally-connectable interface and relies on a combination of form factor and universality of pin layout as built so that both "right handed rotational orientation" and "left handed rotational orientation" are permitted. Users may connect a cable to an electronic device in both an "upside-up" and "downside-up" orientation. The pin layouts in the mating interfaces of the two body parts are symmetrical on either side of a centerplane drawn vertically endwise through the connector (as indicated in FIG. 2B), allowing the connector to be rotated −360, −180, 0, 180 or 360 degrees with no difference in the electrical connection that is made. The concept of "rotationally symmetrical connectivity" or "bi-rotational connectivity" is represented schematically in FIG. 6 and FIG. 7 (rotational bold arrow).

Advantageously, a quick connect coupling adaptor of this first embodiment is a plug-in device that may be retrofitted to existing equipment for charging (or data transmission), and allows the user to make a cable-to-device connection without constraint of proper orientation. In other embodiments the inventive magnetic interface assembly is integral to the device(s) and/or cables used for connecting devices.

The coupling adaptor relies on a magnetic interface so that an electrical connection can be made with a tap and may be detached with a gentle tug. The magnetic interface is described in more detail in the following exploded views.

Figure 3A:
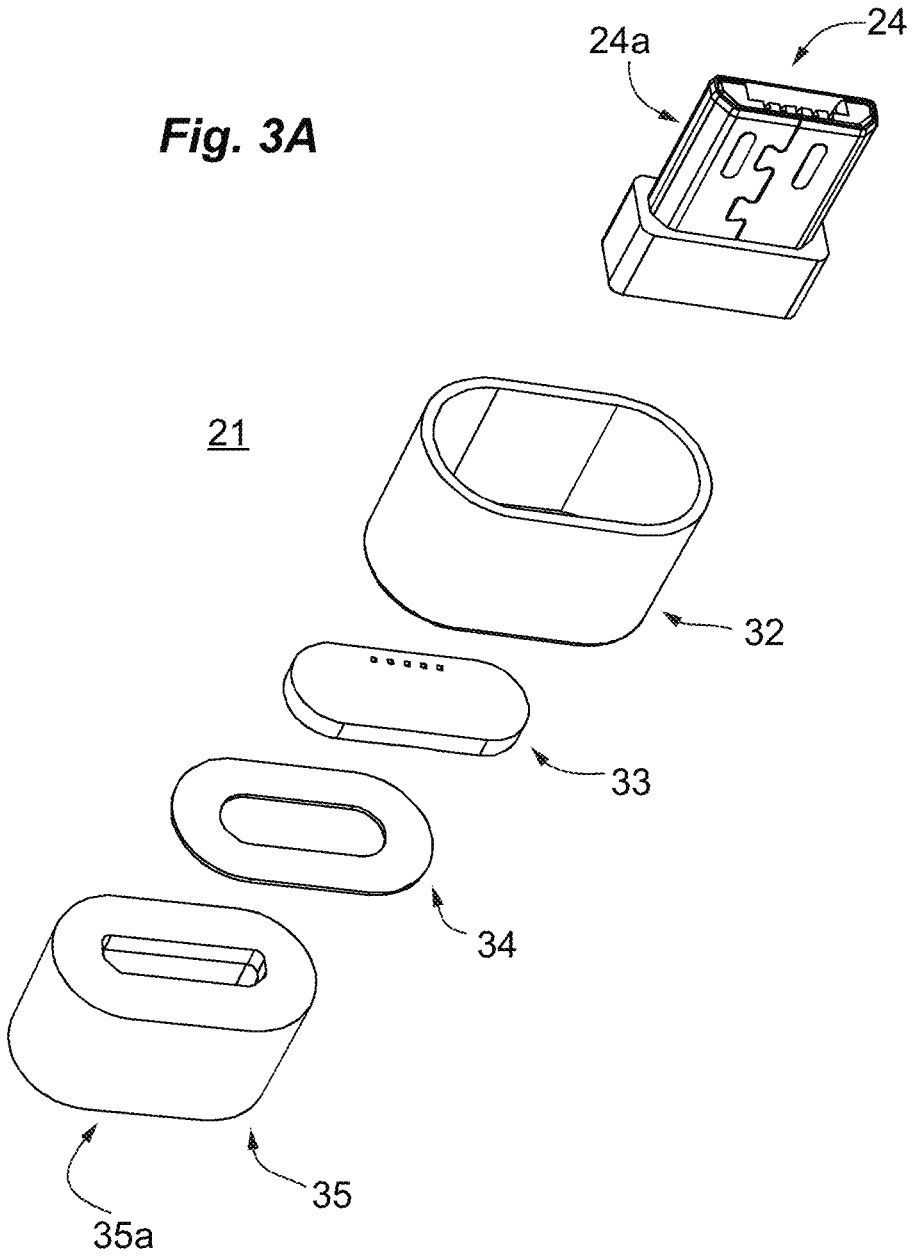
FIGS. 3A and 3B are exploded views of the quick connect USB magnetic interface assembly of FIG. 2A; where
Figure 3B:
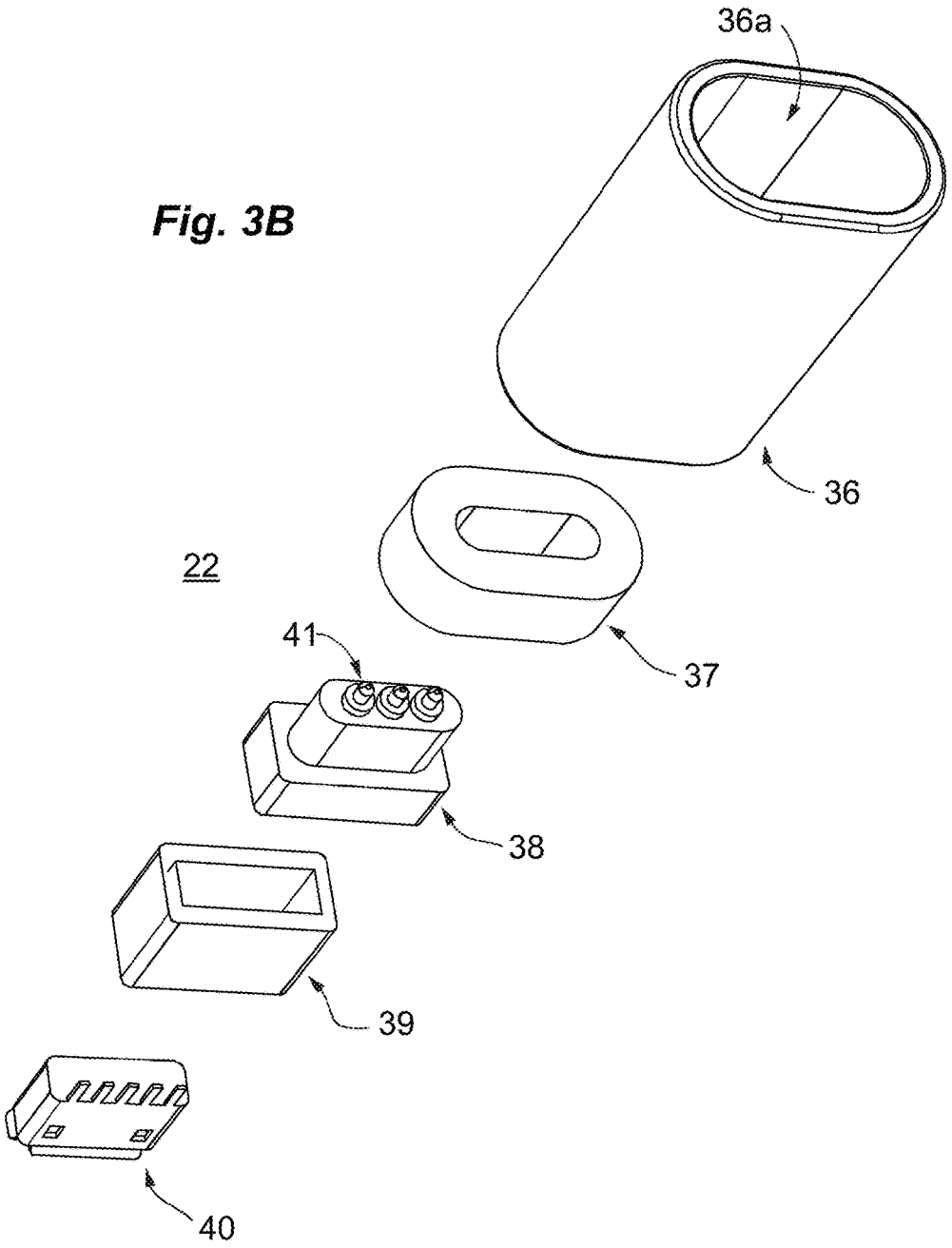

FIGS. 3A and 3B are exploded views of the quick connect adaptor 20 of FIG. 2A; where FIG. 3A shows a first body part 21 and FIG. 3B shows a second body part 22. The assembly of the first body part, from proximal to distal, includes a standard male mini-connector 24*a*; a printed circuit board (33, PCB) with four pads on the distal side, an insulating overlayer 34 seating on the PCB, a machined toroid 35 made from a ferrous material or alternatively a magnetically responsive ceramic that defines a magnetically responsive connector jacket, and a molded outer body or housing 32 with open docking bay 35*a* for receiving the proximal end of the second body part.

The first body part includes an interface surface identified here as a PCB circuit board 33 having pads thereon for contacting the pins of the second body part so as to establish an electrical connection therethrough. Other interface surfaces may be used in place of the pins and the pads.

The body parts are configured so that the interface surfaces are bi-rotationally connectable and are magnetically coupled. The magnetic poles are preferably oriented perpendicular to the plane of the toroid but need not be; any permanent magnet toroid in the second body part will exert a magnetic coupling force on any paramagnetically responsive element in the plug-in body part.

FIG. 3B is a corresponding exploded view of the second body part and includes, from proximal to distal, a molded housing or body 36 that encloses the distal body parts and is dimensioned to hold the internal docking bay of the second body part, a magnetic toroid 37, a 3-pin spring-mounted connector head assembly 38 that inserts into the second body housing inside the docking port, an insulative sleeve 39, and a female connector receptacle 40 for receiving an external cable from a host device. The overlapping outer body sleeve may be used to increase the stiffness of the coupling.

Each pin of the connector is a spring-mounted cylinder or hollow metal finger (see FIG. 20) that is part of a pin head assembly that inserts through the magnetic toroid and is supported on a PCB.

Surprisingly, the use of a toroid is advantageous in two respects: it permits insertion of the pin head assembly circuit board so as to be self-aligning (just as the pads of the circuit board in the first body part are aligned), and also it generates an even magnetic force around the entire circumference of the magnetic interface, stabilizing the coupling. The magnetic toroid may be ferrite or a neodymium composite permanent magnet, for example, and may be magnetized so that the flux is parallel and is axial with the long axis of the connector, or perpendicular and normal to the centerplane defined figuratively in FIG. 2B. Polarity of the magnetic field may be polar with respect to the equator of the toroid, or polar with respect to a centerline drawn through opposite ends or sides of the toroid. The magnet acts on a magnetically responsive metal core or sleeve mounted in the first body part. The magnetic field is sufficient to provide a gentle attractive pull on the body parts, such that high flux density rare earth magnets are not generally needed. Weaker ceramic magnets may also be used, provided the flux density is sufficient to detachably hold the body parts together.

The magnetic field produced by small to medium-sized rare-earth magnets can be in excess of 1.4 Teslas. A typical refrigerator magnet may have 50 Gauss; a small iron magnet perhaps 100 Gauss. Small neodymium magnets (neodymium-iron-boron, NIB, grade N42 or higher) may produce in excess of 2000 Gauss (2 Teslas). Preferred interface devices have been constructed using small rare-earth magnets in the second body part for magnetically coupling a magnetically responsive core or sleeve in the first body part with sufficient pull so that the two interface surfaces are readily separated by deliberate detachment, but do not wobble or spontaneously disconnect in normal use.

Alternatively, individual pins of the electronic contacts may be magnets and/or magnetically responsive members. Typically, linear or field arrays of contacts are needed. Contact arrays may have as few as 2 pins, or as many as 30 or 64 pins depending on the data and power transfer requirements. Advantageously, by using magnetic pins to make electrical contacts, the individual pin faces may be planar so as to reduce contact resistance and the interface thickness may be more compact. Gold plating can be used to increase conductivity and the magnets may be soldered below their Curie temperature (or otherwise affixed) to a pliant circuit board layer so as to self-correct any misalignment of the interface surfaces between the contacts. When used in arrays, directionality may be established by orientation of the poles of the contacts, such that repulsive and attractive forces are used to direct the coupling in the required orientation, or poles may be oriented in common so as to maximize attractive forces and establish bi-rotationality of the array. Preferably, magnets are used so that the attractive forces are cooperative because use of a magnetic coupling where attraction and repulsion are used to establish directionality may be experienced by users as irksome. By using a single permanent magnet in combination with a magnetically response core in the mating interface part, the resultant bi-rotationally enabled couplings of the invention are found to be both strong and convenient to use.

FIGS. 4A and 4B are exploded views of the quick connect adaptor 20 of FIG. 2A; where the assemblies are labelled as before but presented in an alternate perspective view. As shown here, three spring-mounted pin "fingers" 41 of the second body part 22 (FIG. 4B) contact three pads 42 of the PCB circuit board 33 (FIG. 4A) to close the electrical circuits between the two interface surfaces. Also shown in FIG. 4A is the male end of a micro-connector 24*a*, a molded male outside body 32 or housing, an insulative overlayer 34 that seats on the PCB 33, and a magnetically responsive toroid 35 (here made of machined steel) that slips inside the housing 32. FIG. 4B shows a magnet that slides inside a female coupling body or housing 36 with docking bay 36*a*, the three-pin connector head 38, an insulative collar or sleeve 39, and a female micro-connector cable receiving port 40. The second body part is configured at a distal end (25, bottom right) for receiving a cable from a host device.

Figure 5A:
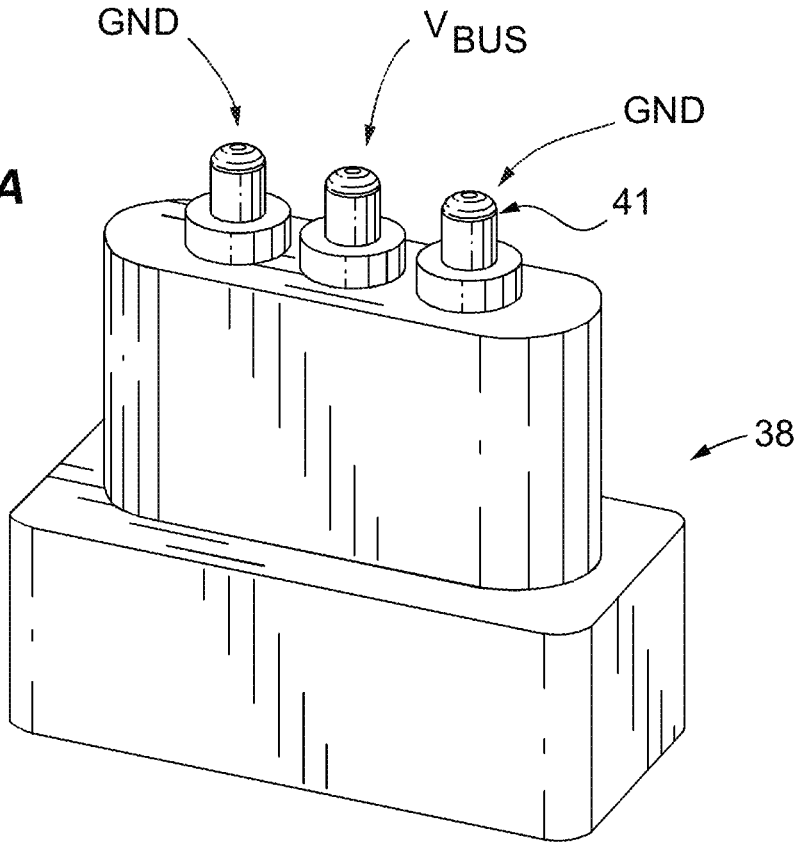
FIG. 5A is a perspective view of a 3-pin spring-mounted connector embodiment of a second body part.
Figure 5B:
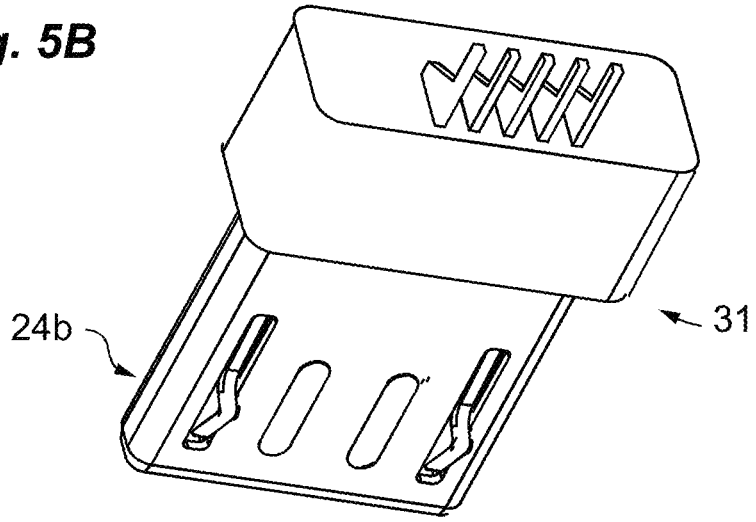
FIG. 5B is a perspective view of a bi-rotationally coupleable first "plug-in" body part configured to be inserted into an I/O port of a first electronic device.

FIG. 5A is a detail view of pin head assembly 38 having three pins 41. This embodiment is configured for transmitting power in either of two orientations (i.e., with dual ground). Each pin is spring-mounted so as to bias the engagement of the pins with corresponding pads 42 on the PCB circuit board 33 of the first body part 21. Pins correspond to GND, $V_{BUS}$, and GND (alternative ground), demonstrating a rotationally symmetrical electrical connectivity. FIG. 5B is a perspective view of a coupleable first "plug-in" body part 31, here with prominent THUNDERBOLT® insertable connector 24*b* configured to be inserted into a receiving port of a mobile device.

Figure 6:
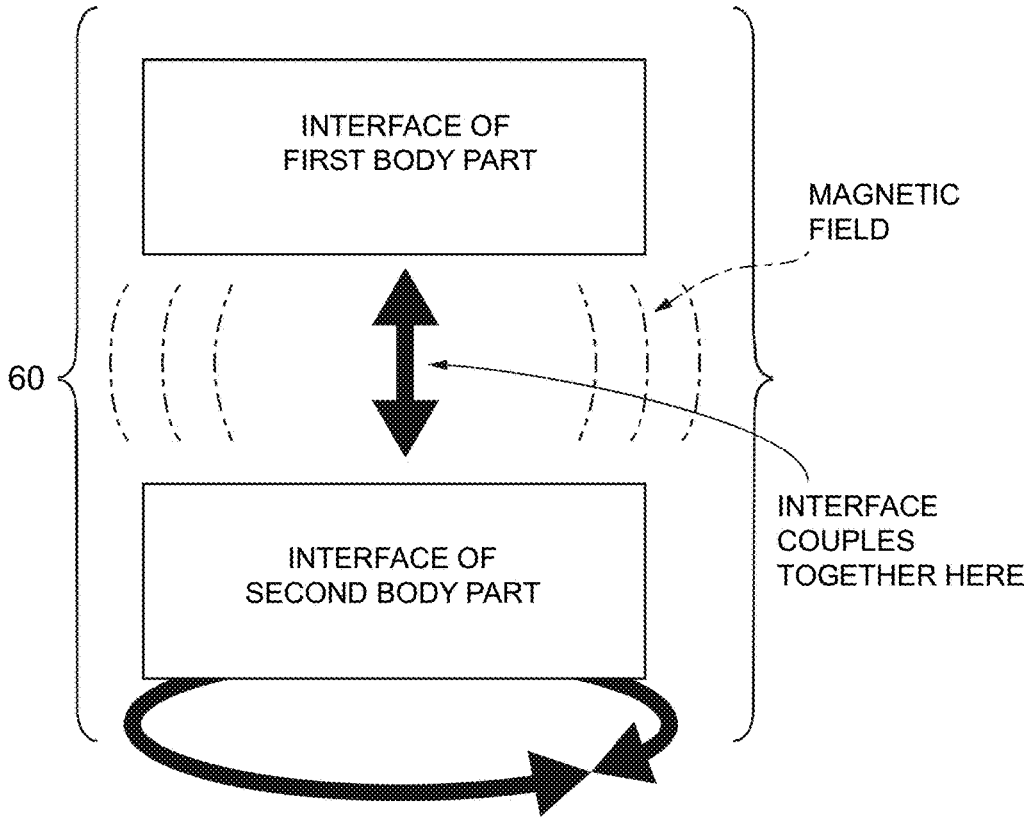
FIG. 6 is schematic view of a magnetic interface coupling for electrically joining the first and second body parts in either of two rotational frames of reference (bold elliptical arrow).

FIG. 6 is schematic view of an interfacial connector with magnetic coupling for electrically joining a first and second electronic module or device in either of two rotational frames of reference (bold arrow). By configuring the pin layout and leads (FIG. 7) with a redundant duplex ground on the proximal side, and a reversibly attachable magnetic interface 60 between the body parts, the interface having rotationally symmetrical electrical connectivity, a bi-rotationally-connectable charging adaptor is achieved. The concept is described schematically by depicting an elliptical double headed arrow to indicate rotational freedom and a straight double headed arrow to indicate the action of bringing two electronic modules (or a connector therebetween) into electrical contact. Dashed curved lines indicate a magnetic coupling. The directionality of the magnetic flux is shown for illustration only and may be varied according to the polarity of the permanent magnet or magnets in the assembly. One or both of the modules (or connector parts) may include a permanent magnet. When only one part includes a permanent magnet, the other part is provided with a magnetically responsive core or sleeve so as to cause an attractive force between the two modules or connector parts. The strength of the magnetic field is adjusted so that the interface coupling attachment is convenient, reasonably strong, and easy to disattach.

In some instances, the invention is used to join a cable to a device or a quick connect adaptor to a cable. In other instances two devices are joined. In yet other instances, a device is joined to a charging dock. As will be discussed below, the concept of rotationally symmetrical connectivity may also be used to facilitate bi-rotationally-connectable data sharing interfaces such as may be used for synchronizing data on two devices, for backup of data from a first device to a second device, for copying files to a printer or other peripheral device, for playing music on a peripheral device, and so forth without limitation thereto.

Figure 7:
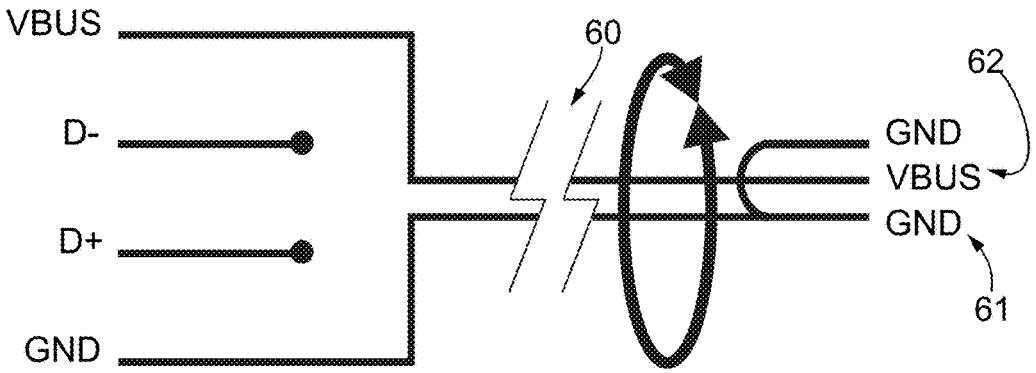
FIG. 7 is a circuit schematic for a magnetic interface assembly of the invention that is connectable in either of two rotational frames of reference (bold elliptical arrow).

FIG. 7 is a circuit schematic for a charging adaptor of the invention that is connectable in either of two rotational frames of reference. The circuit is drawn to illustrate a rotationally symmetrical connection, where an elliptical doubleheaded arrow indicates the property of rotational freedom of the interface 60. A crossover is made on for example a PCB or equivalent support so that either ground (61, GND) is equivalent in operation and a center pin (62, VBUS) is hot. Bi-rotational-connectability is a function of the combined male and female interface, and the roles of the two sides of the interface are interchangeable. Shown here, the cross-connection is made on the device side, but this is a matter of convenience for the designer. In this way a power connection may be made in either a right-handed or a left-handed orientation (i.e., in either an upside-up or a downside-up orientation) using a 3-pin proximal connector so that the user is no longer required to inspect the connector and verify proper insertion. In this view, data leads (D+, D−) are left open, but data sharing may also be accomplished by the quick connect interfaces of the invention as shown in FIGS. 9, 10, and other figures described below.

Figure 8A:
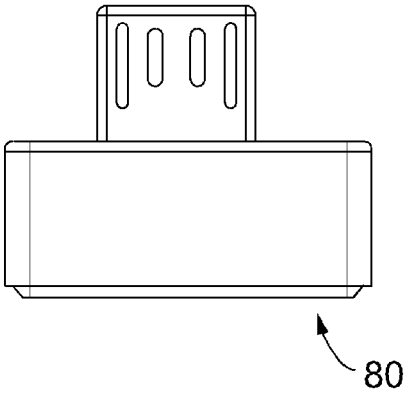
FIGS. 8A and 8B are first body parts.
Figure 8B:
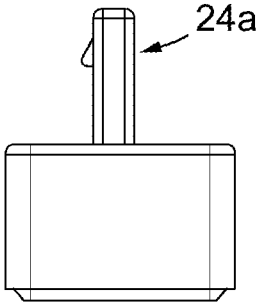
Figure 8C:
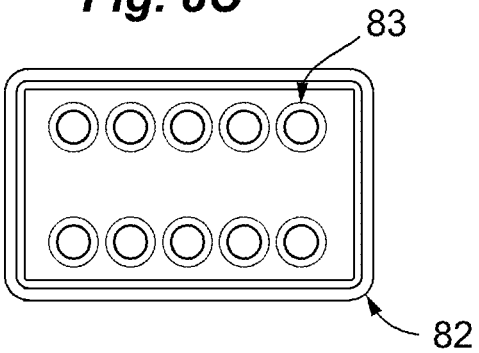
FIG. 8C shows a top view of the second body part of FIG. 8D.
Figure 8D:
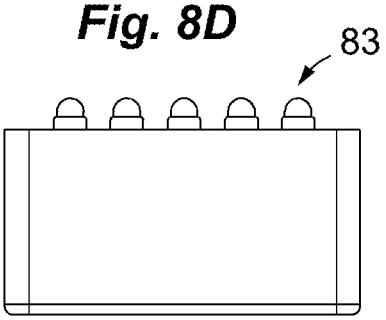
FIGS. 8D and 8E are views of a second body part having a ten-pin layout for a bi-rotational magnetic interface assembly of the invention.
Figure 8E:
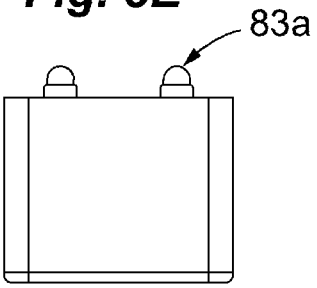

FIGS. 8A and 8B are views of an alternate first body part 80 having a THUNDERBOLT® plug-in connector 24*a*. FIG. 8C shows an underside view of the second body part 82 of FIG. 8D. FIGS. 8D and 8E are views of the second body part 82 having a ten-pin layout 83 for a bi-rotational data and power quick connect of the invention. Regardless of rotational orientation, the male plug-in connector 24*a*

(FIG. 8B, top) is electrically connected through one of the rows of pins in the mirror symmetrical coupling interface. As can be seen, the interfacial electrical connectors between the two body parts are equivalent regardless of the handedness of the insertion, and are essentially a universal interface such that right-handedness and left-handedness are no longer functionally distinct.

Figure 9A:
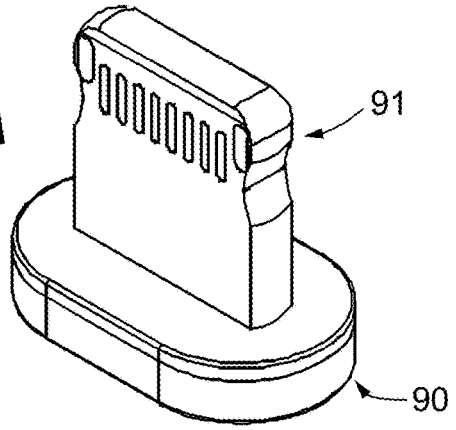
FIG. 9A is a perspective view of a first body part for a data sharing magnetic interface assembly of the invention. The male plug-in end is configured to be compatible with a variety of LIGHTNING® products.
Figure 9B:
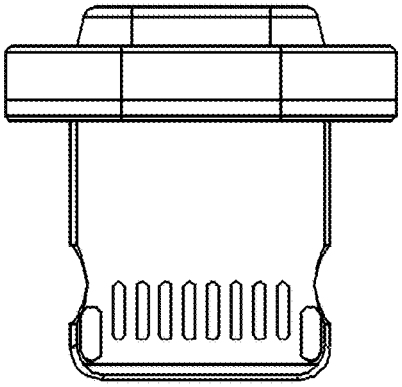
FIGS. 9B and 9C show the piece in side view and end view respectively.
Figure 9C:
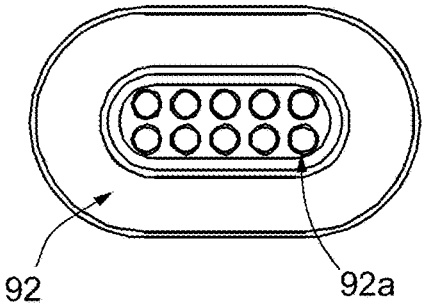
Figure 9D:
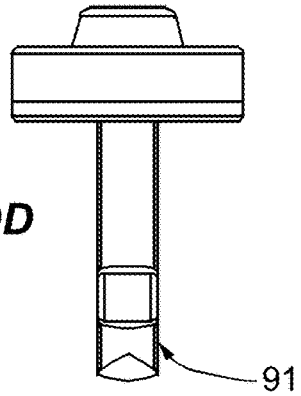
FIGS. 9D and 9E are edgewise and top views respectively. The pin layout consists of two rows so as to be axisymmetrical and have a rotational axis of symmetry such that a 180 degree bi-directional rotation of the male or second body part will result in an electrically equivalent pin configuration.
Figure 9E:
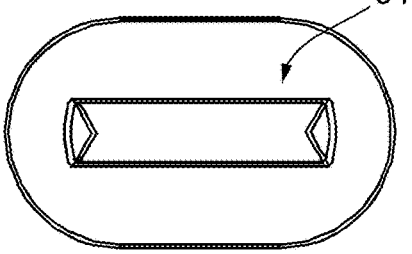

FIG. 9A is a drawing of a data sharing of an alternate first body part 90 (termed commercially a first embodiment of a "Plugie") of the invention. Shown in perspective is a view of a first body part for a data and power sharing adaptor of the invention. The male plug-in end (91, top) is configured to be compatible with a variety of LIGHTNING® products. FIGS. 9B and 9C show the piece in side view and end view respectively. FIGS. 9D and 9E are edgewise and top views respectively. The pin layout 92*a* on the distal face 92 of the first body part consists of two rows of pads so as to be axisymmetrical and have a rotational axis of symmetry such that a 180 degree bi-directional rotation of the male or second body part will result in an electrically equivalent circuit configuration. Pad wiring is bi-rotationally-connectable so that the user is no longer required to inspect the connector and verify proper insertion. Redundancy in the pad connections results in a rotationally symmetrical electrical connectivity.

Figure 10A:
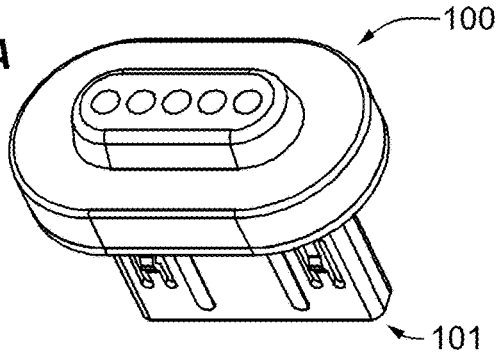
FIG. 10A is a perspective view of a first body part for a data sharing magnetic interface assembly of the invention. The male plug-in end is configured to be compatible with a variety of THUNDERBOLT® products.
Figure 10B:
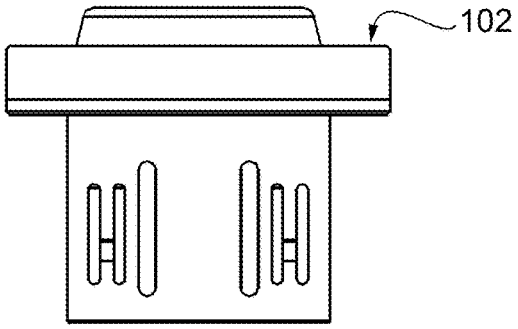
FIGS. 10B and 10C show the piece in side view and end view respectively.
Figure 10C:
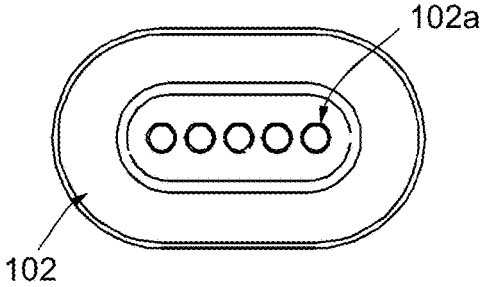
Figure 10D:
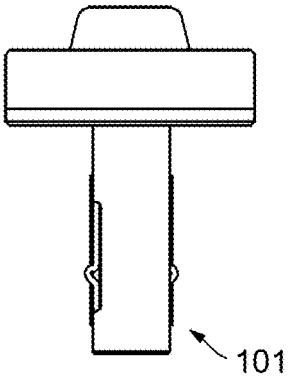
FIGS. 10D and 10E are edgewise and top views respectively.
Figure 10E:
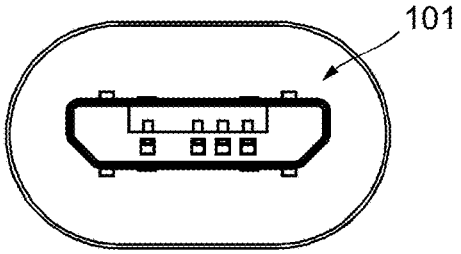

FIG. 10A is a perspective view of an alternate first body part 100 (identified as a second embodiment of a "Plugie" as offered commercially) for a data and power sharing quick connect of the invention. The male plug-in end 101 is configured to be compatible with a variety of THUNDERBOLT® products. FIGS. 10B and 10C show the piece in side view and end view respectively. FIGS. 10D and 10E are edgewise and top views respectively. The pad layout on the distal face 102 consists of a single row 102*a* but is configured so as to be axisymmetrical and have a rotational axis of symmetry such that a 180 degree bi-directional rotation of the first or second body part will result in an electrically equivalent pin configuration. FIG. 10F is a view of the proximal face of the plug-in connector 101.

Figure 11A:
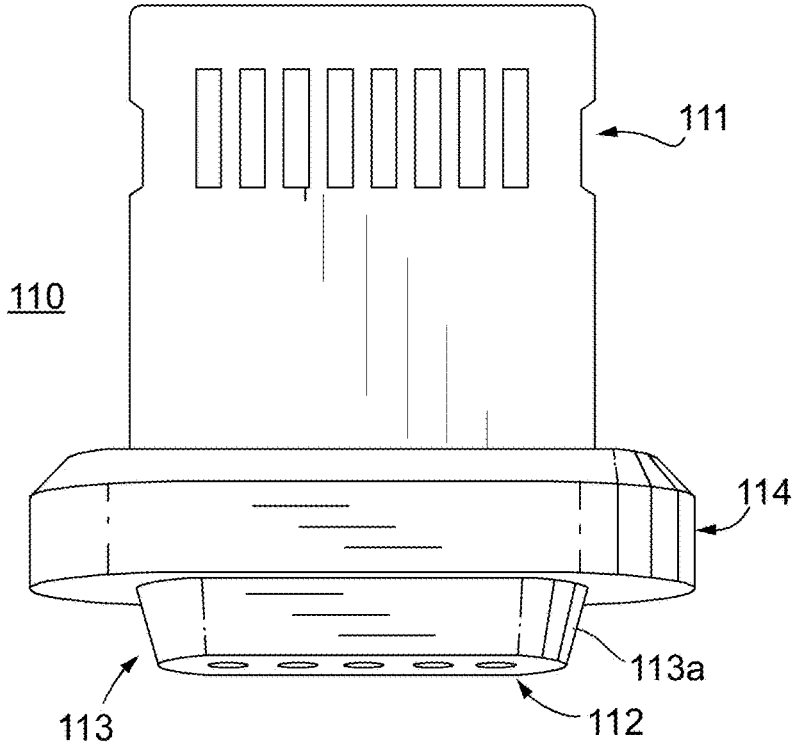
FIG. 11A is a representation of a magnetic interface assembly having a male LIGHTNING® plug-in (top) and a pin-contacting electrical interface (bottom) with magnetically responsive element.

FIG. 11A is a representation of a 5-pin adaptor or coupling 110 having a male LIGHTNING® plug-in (111, top) and a pin-contacting electrical interface (distal face 112, bottom) surrounded by a magnetically responsive element 114. Plugies of this species are typically used with APPLE® products, including the iPHONE®, for example. The supporting collar is typically a paramagnetic material, made for example of stainless steel, and may be anodized to present an appealing color. The mounting for the pin-contacting electrical interface 113 is characteristically beveled 113*a* to facilitate the mating alignment. Electrical pads are disposed on the distal face 112 of the interface.

Figure 11B:
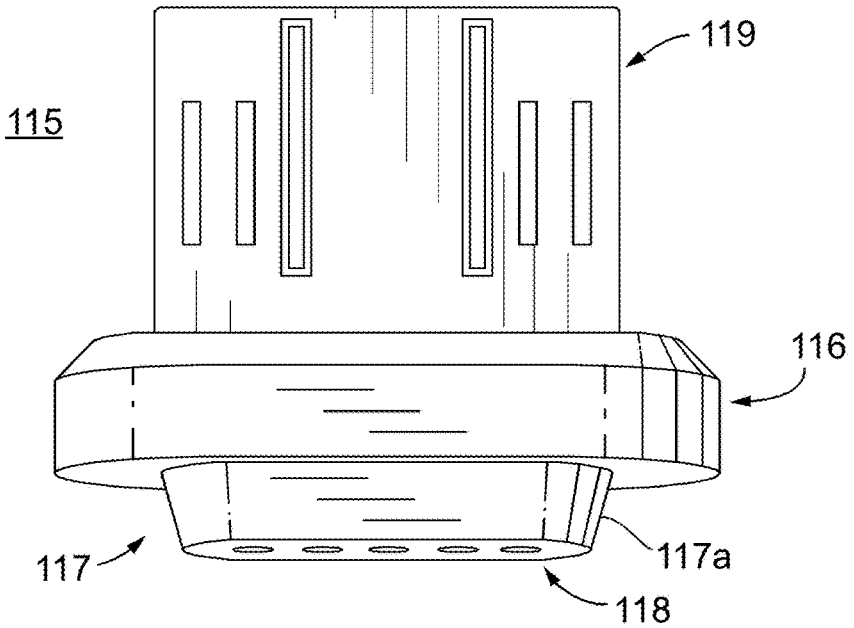
FIG. 11B is a representation of a magnetic interface assembly having a male THUNDERBOLT® plug-in (top) and a pin-contacting electrical interface (bottom) with magnetically responsive element.

FIG. 11B is a representation of another 5-pin adaptor or coupling 115 having a male THUNDERBOLT® plug-in (119, top) and a pin-contacting electrical interface (118, bottom) with magnetically responsive element. This interconnect is a "Plugie" used with ANDROID® products, for example. The supporting collar 116 is typically a paramagnetic material, made for example of stainless steel, and may be anodized to present an appealing color. The pad mounting for the pin-contacting electrical interface 117 is characteristically beveled 117*a* to facilitate the mating alignment. Electrical pads are disposed on the distal face 118 of the interface.

Figure 12A:
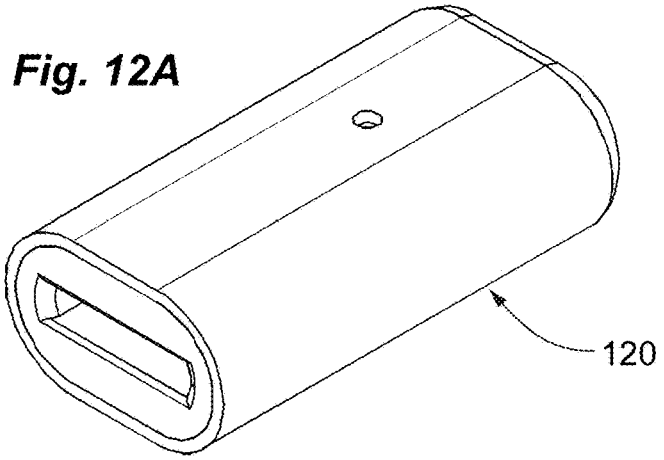
FIG. 12A is a perspective view of a second body part of a quick connect interface.
Figure 12B:
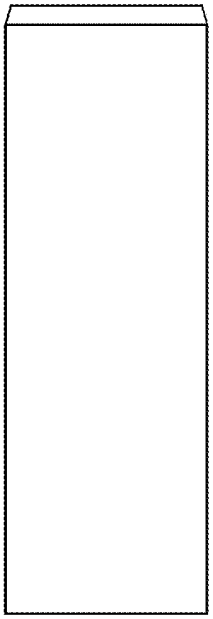
FIGS. 12B and 12C show the piece in side view and top view respectively.
Figure 12C:
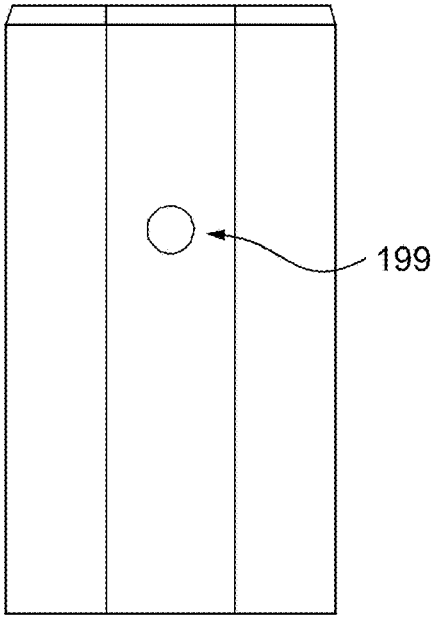
Figure 12D:
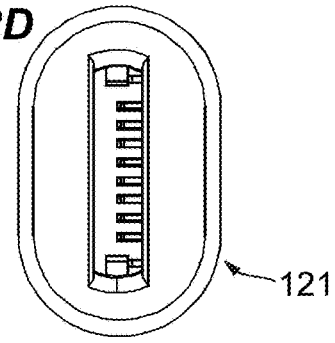
Figure 12E:
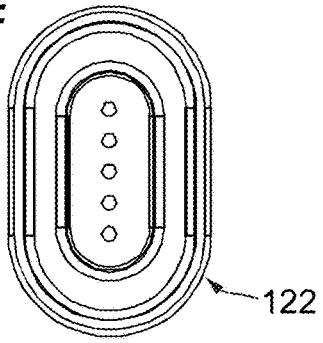
FIG. 12E is a proximal end view of the magnetic interface with pins and magnetic toroid configured to mate with the outside end of the plug-in body member.

FIG. 12A is a perspective view of an alternate 5-pin second body part 120 of a quick connect interface. FIGS. 12B and 12C show the piece in side view and top view respectively. FIG. 12D is a detail view of a distal end 121 and shows a receiving port for a cable with male THUNDERBOLT® plug-in. FIG. 12E is a proximal end view 122 of the magnetic interface with pins and magnetic toroid configured to mate with the outside end of the plug-in body member. The pin layout consists of one row of five pins having a rotational axis of symmetry such that a 180 degree bi-directional rotation of the first or second body part will result in an electrically equivalent pin configuration. The supporting housing is typically a plastic or metal shell, and may be anodized to present an appealing color. A function indicator LED 199 is mounted in the housing.

Figure 13:
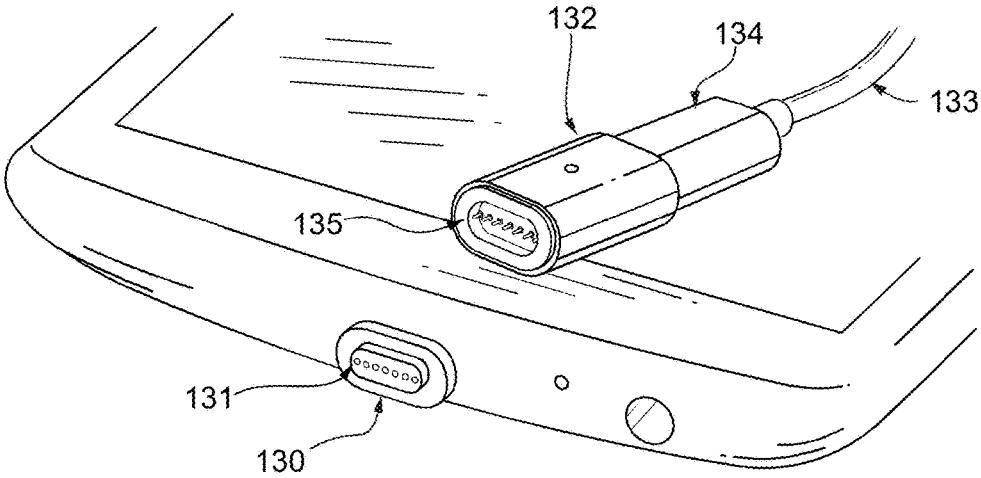
FIG. 13 is a perspective rendering of a first body part seated in an electronic device (here a smart phone) and a mating end view of a second body part.

FIG. 13 is a perspective rendering of a 7-pad first body part 130 seated in an I/O/power port of a mobile device (here a smart phone) and a mating end view of a second body part 132 with cable 133 resting on top of the smart device. Seven pads 131 on the first body part are configured to engage seven pins on the second body part. The second body part also includes a magnetic toroid and the first body part includes a magnetically responsive element configured to generate a symmetrical and even magnetic coupling between the two parts such that the parts can be easily separated but are in electrically patent communication when seated together. Each of the pins 135 is spring-mounted such that the spring force opposes the magnetic force to ensure a solid connection. The quick connect adaptor is configured to transfer data and power across the interface 140 as shown in FIG. 14.

The cable end connector assembly 134 plugs into the second body part and is detachable, so that the three-piece combination includes a first plug-in body part 130, a second body part 132, and a cable with end connector head 134. The second body part can be swapped out so that both LIGHTNING® and THUNDERBOLT® cable assemblies may be used.

In this embodiment, the first body part 130 would be installed in a device and a cable connection is made to the exposed 7-pin interface by a docking step so that the two interface surfaces are smoothly mated and electrically connected with a tap and smoothly disengaged with a gentle tug. However, integrated designs having a board-mounted 7-pin interface may be made that accept a cable connector having rotationally symmetrical electrical connectivity (i.e., a two-piece assembly). The roles of "first" and "second" are designated only for brevity in explanation and have no physical significance.

Figure 14:
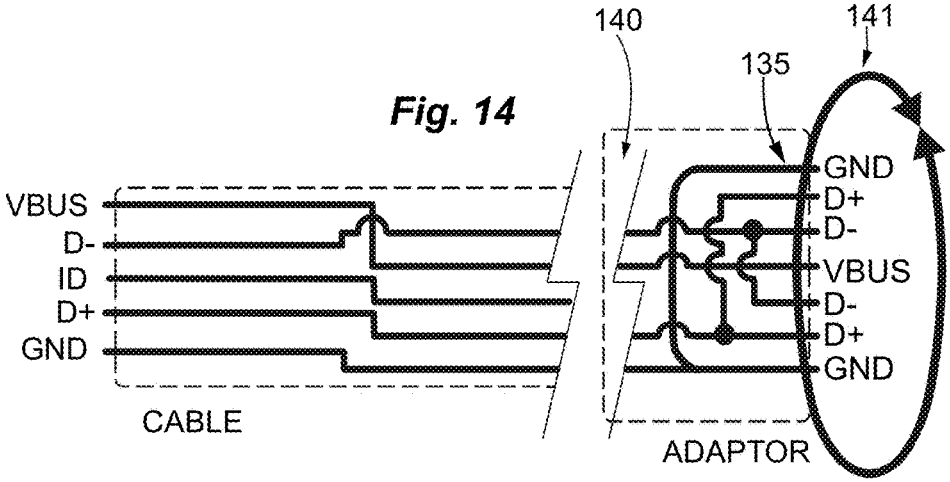
FIG. 14 demonstrates that the interface has rotationally symmetrical electrical connectivity, i.e., it is functionally equivalent in a first orientation position and a second orientation position in which the interface is rotated 180 degrees. The bold arrow conveys the bi-rotatable symmetry of the electrical interface.

FIG. 14 is a schematic of a bi-rotatable adaptor with a cable. Suitable cables are known in the art. The adaptor allows the user to make a device-to-cable-to-device connection without constraint of proper orientation by using the adaptor. Adaptor body part is a female connector and has 5-pin input and a 7-pin output. The 7-pin output is rotationally symmetrical such that a 180 degree rotation of the cable or female connector, either clockwise or counterclockwise, results in an identical connection. In this embodiment, the first body part would be installed in a device receiving port and then a cable connection is made to the exposed 7-pin interface by a docking step so that the two interface surfaces are smoothly mated and electrically connected with a tap and smoothly disengaged with a gentle tug. The second adaptor body part is configured connect at junction 140 for sharing data and power. The junction may be a plug junction or a hard-wired junction.

As shown in FIG. 14, the magnetic interface 141 of the second body part (ADAPTOR) has rotationally symmetrical electrical connectivity, i.e., it is functionally equivalent in a first orientation position and a second orientation position in which the interface is rotated 180 degrees; the seven pin connections (GND, D+, D−, VBUS, D−, D+, GND) are symmetrical on either side of the VBUS contact in mirror image order and can be mated with the representative first body part interfaces 130 shown in FIGS. 11A, 11B and 13. The bold elliptical arrow conveys the bi-rotatable symmetry of the electrical coupling with magnetic interface 141 of the adaptor.

The second body part is configured to be mated at a distal end to a standard USB cable having five pins, where VBUS is a power plug, GND is ground, D+ and D− are data lines, and ID is an extra pin. The extra pin ID as shown here is not connected, but optionally may be connected for devices in need of another wire lead to the device. The 5-pin input is typically standard wiring for a USB A cable.

The first body part may be mounted in a receptacle on a mobile device, and the second body part is mounted endwise so that a cable can be plugged into a cable receptacle. Alternatively, the second body part may be permanently mounted endwise on the cable. Cables are conceived in two configurations. In one, the cable end connector inserts into a female receptacle in the second body part (i.e., a three-piece assembly). But in the other configuration, the cable is manufactured with the second body part as its end connector (i.e., a two-piece assembly), eliminating the plug junction at the distal connector end of the second body part.

The cable may be either a plug-in or an integral part of the second body part. A integral cable is illustrated in FIGS. 13, 17A, 17B, 18A, 18B, and FIGS. 19A through 19C, for example. Provision for a plug-in cable is demonstrated in FIGS. 16A, 16B, 16C, 16D, 16E, 16F, and 16G, for example.

The cable is used to join two devices, typically a mobile or guest device and a host device, and to facilitate bi-rotationally-connectable data sharing interfaces such as may be used for synchronizing data on two devices, for backup of data from a first device to a second device, for copying files to a printer or other peripheral device, and so forth.

Thus the cable is conceived as used for sharing data and/or sharing power and the magnetic interface assembly ("coupling adaptor") of the invention, whether integrated into the cable or not, is configured to facilitate data exchange and power through its rotationally symmetrical electrical connectivity. The cable and its connection to the adaptor in either of two rotational configurations is part of the concept.

Figure 15:
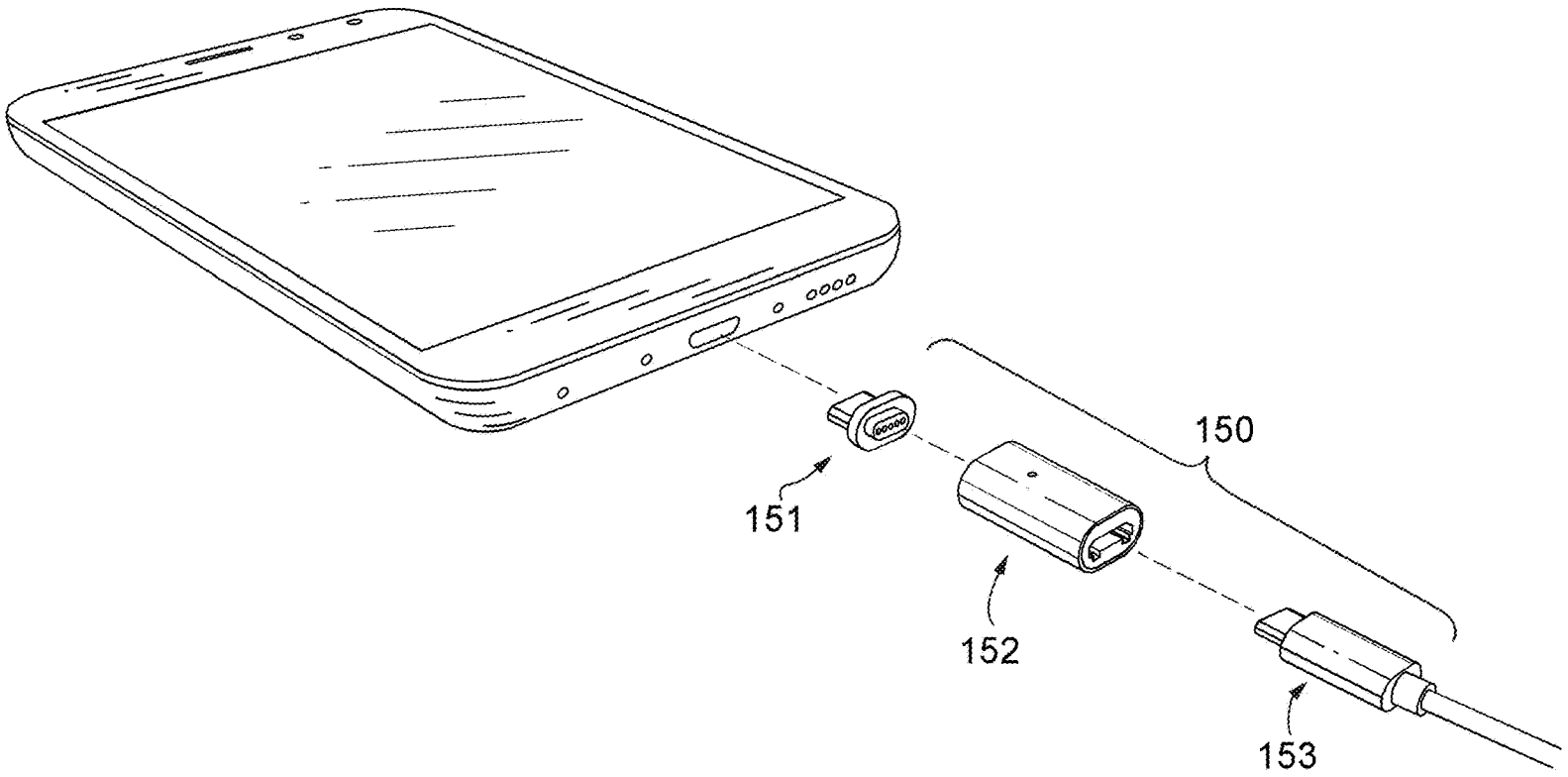
FIG. 15 is a view of a three-part quick coupling magnetic interface assembly for insertion between an electronic device (here shown as a smart phone) and a standard cable (equipped here with a THUNDERBOLT® cable end.

FIG. 15 is a view of a "three-part" quick coupling adaptor 150 for insertion between an electronic device (here shown as a smart phone) and a standard cable (equipped here with a THUNDERBOLT® cable end 153. The first body part 151 includes a THUNDERBOLT® cable plug-in so as to match the receiving port in the smart device. Joining the cable and the distal end of the first body part is a second body part or "coupling adaptor" 152. Thus the three-part quick coupling adaptor may be inserted between the cable and the device so as to realize a quick magnetic coupling that snaps into place and is easily pulled apart. The second body part 152 may be supplied as part of a three-piece kit (with separate cable, which may be supplied in the kit or supplied by the guest device manufacturer) making up the quick coupling adaptor 150 and is compatible with first body part 153. The first and second body parts may be provided in multiple species corresponding to the various cables and receiving ports on one or more guest devices.

Figure 16A:
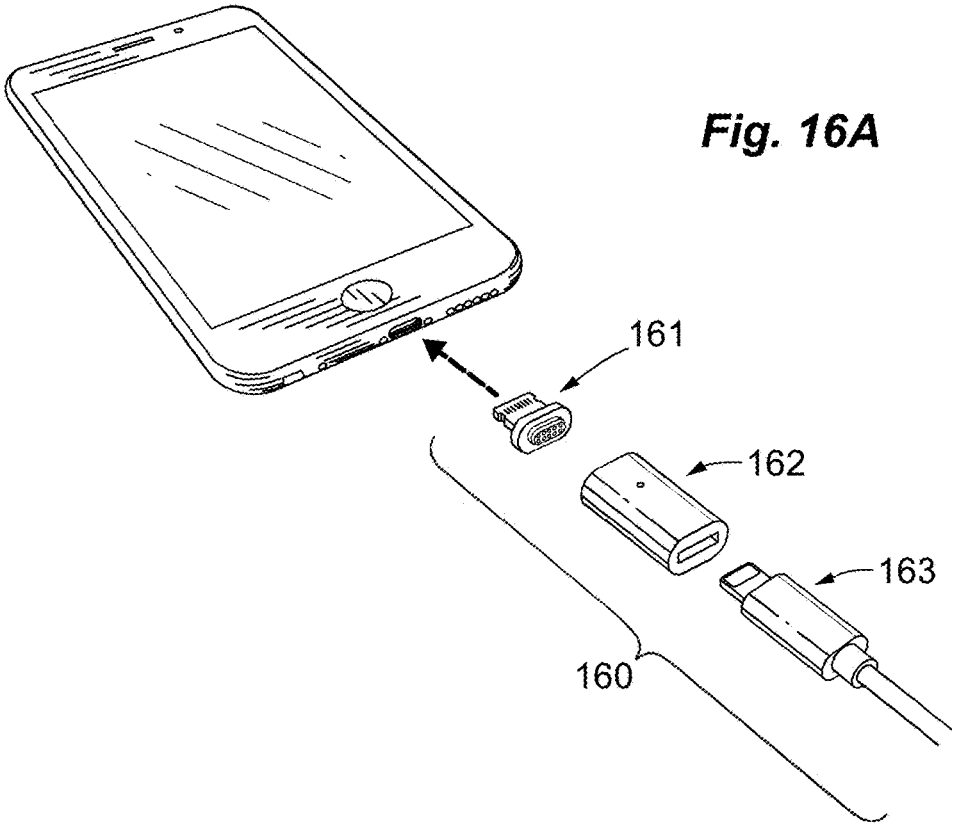
FIG. 16A is a view of a three-part quick coupling magnetic interface assembly for insertion between an electronic device (here shown as a smart phone) and a standard cable (equipped here with a LIGHTNING® cable endpiece).

FIG. 16A is a view of a second species of "three-part" quick coupling adaptor for insertion between an electronic device (here shown as a smart phone) and a standard cable (equipped here with a LIGHTNING® cable end. The first body part includes a LIGHTNING® cable plug-in so as to match the receiving port in the smart device. Thus the three-part quick coupling adaptor may be inserted between the cable and the device so as to realize a quick magnetic coupling that snaps into place and is easily pulled apart.

Figure 16B:
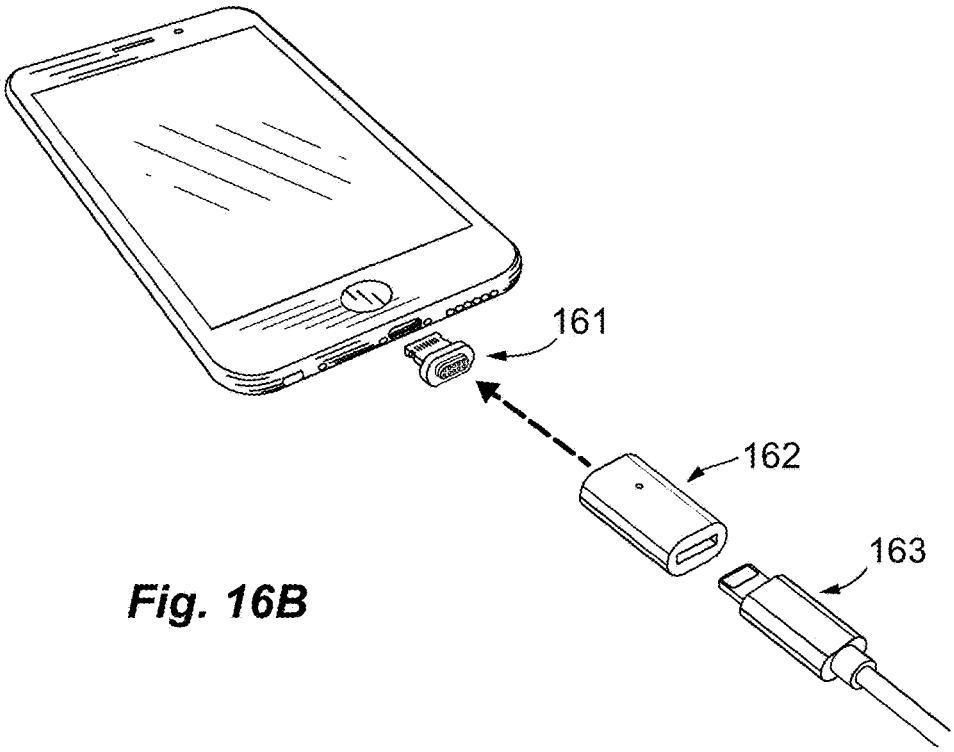
Figure 16C:
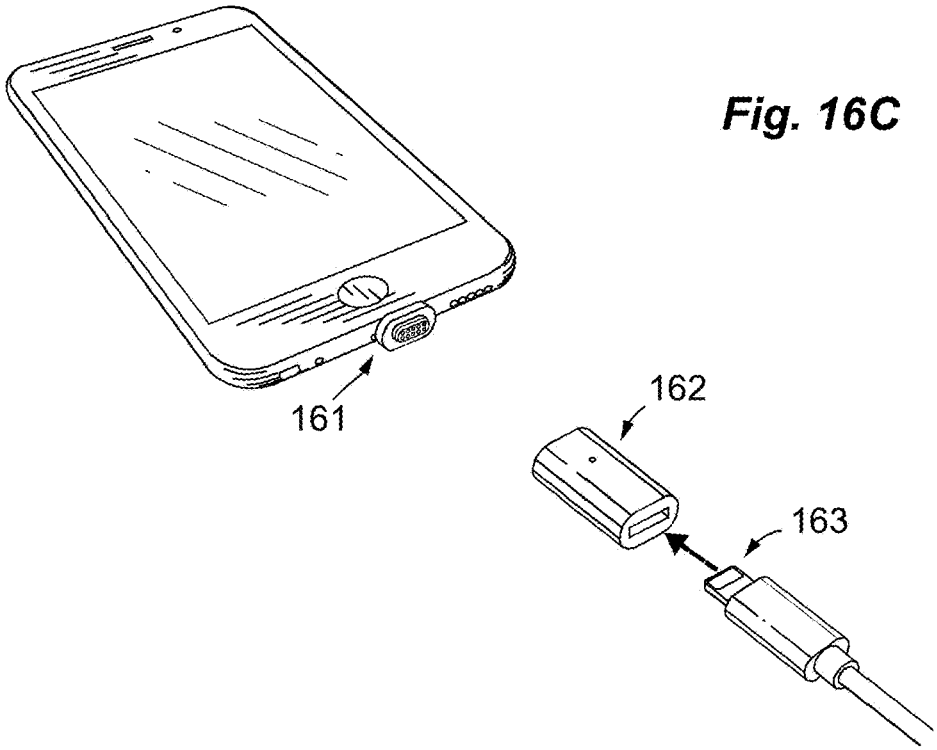
Figure 16D:
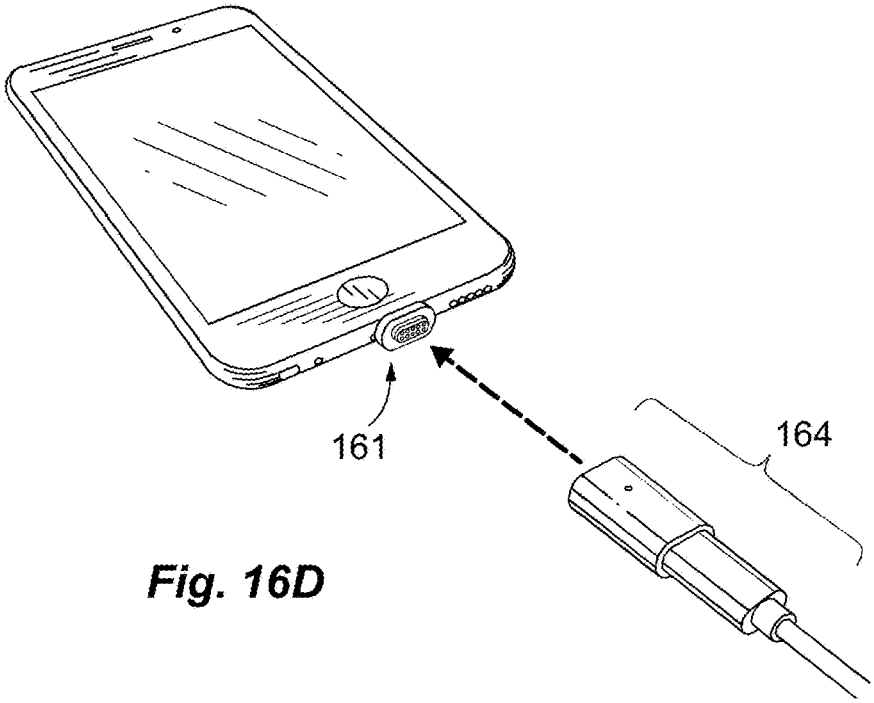
Figure 16E:
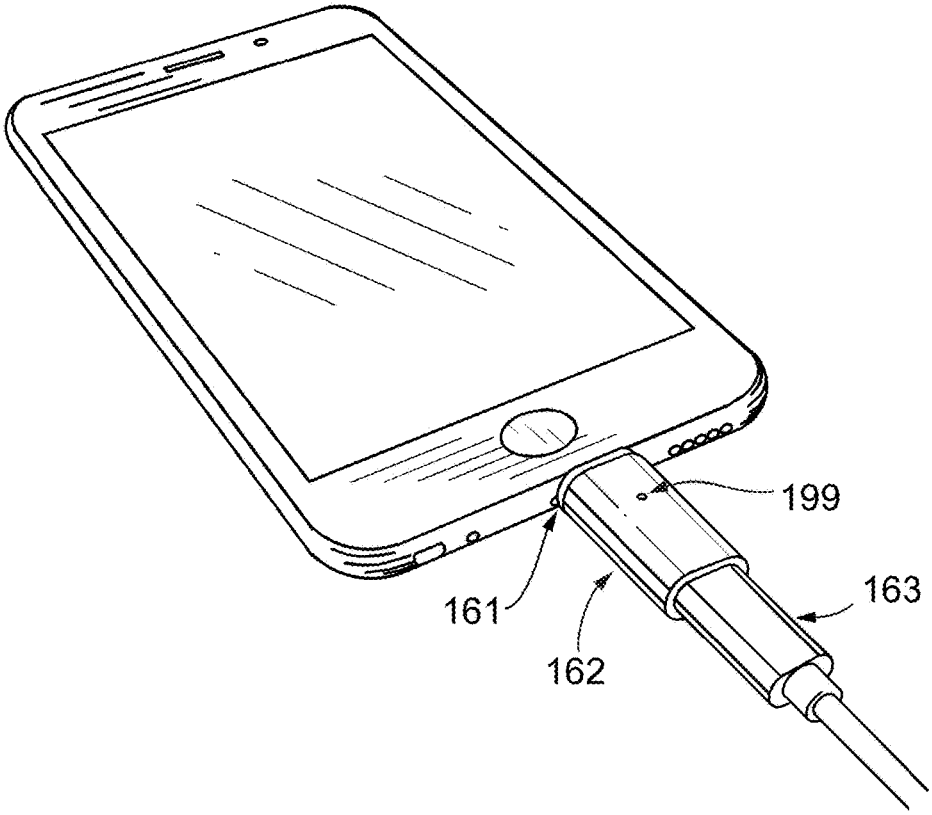

FIGS. 16A through 16E show the steps of a method for use of a three-piece quick coupling adaptor 160 with a guest device, here depicted as a smart phone. Typically, as illustrated in FIG. 16B, the first plug-in body part 161 is inserted into the portable smart device 162. Next, as shown in FIG. 16C, the mobile cable end 163 is inserted into the second body part. The intermediate result is shown in FIG. 16D, where the first body part is resident in the smart device and the second body part is resident on the end of the cable as a unit 164. The order of making connections is of course not limited as shown.

When brought together, the two parts (161,162) are magnetically coupled with a "snap", and the circuit is electrically patent regardless of which rotational orientation of the body parts is selected. Here a light emitting diode 199 is mounted in the center of the second body part is illuminated, confirming for the user that the connection is electrically patent and the interface is transmitting power or data and power. Breaking the connection causes the LED to go dark.

Figure 16F:
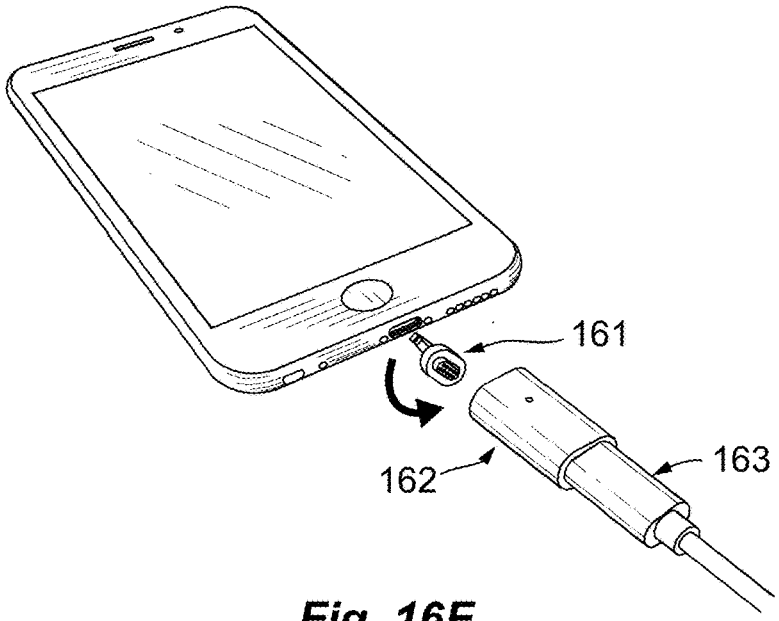
FIGS. 16F and 16G demonstrate how rotation of any one of the coupling body parts results in an equivalent circuit.
Figure 16G:
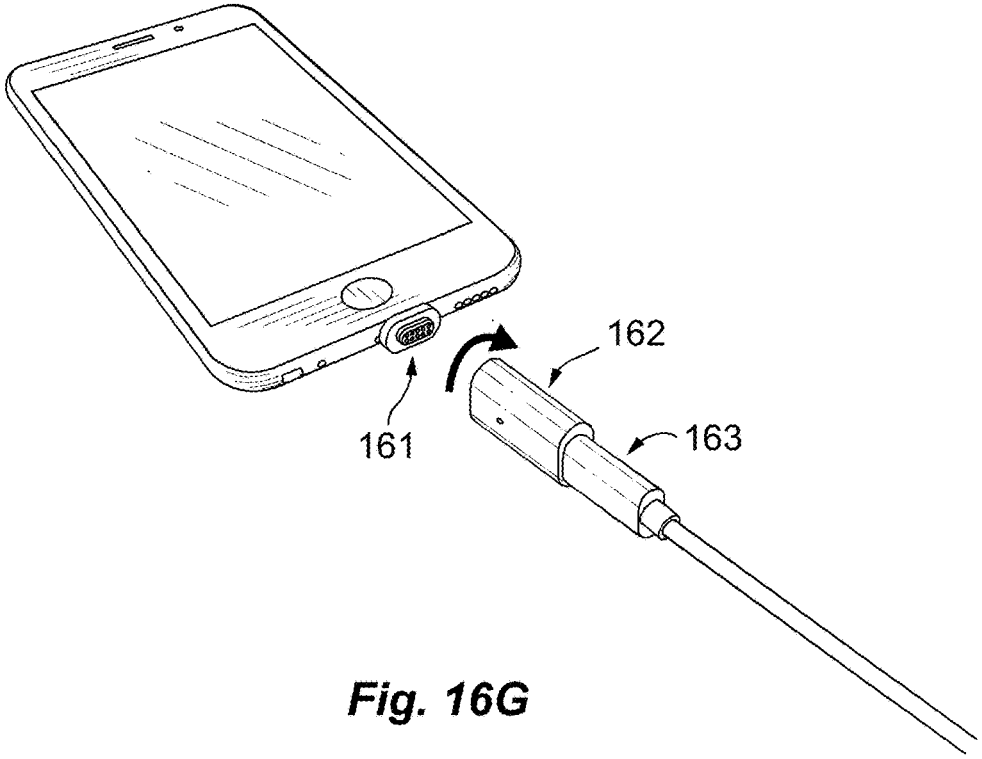

FIGS. 16F and 16G illustrate the versatility of the device and method. The user can reliably achieve a connection regardless of the orientation of either of the two parts (161,162) of the quick connect coupling. Either can be flipped with no effect on the electrical connectivity. Disassembling is the reverse of assembling but users can choose to permanently leave a first body part as shown in the mobile device. Multiple mobile devices can be set up in advance to have the first body part installed. The second body part can remain on the cable, allowing the user to switch the cable from one device to another with no need to struggle to find the correct orientation. Advantageously, the magnetic connector interface is easily broken whenever the user pulls the two pieces apart. While in this instance a three-part magnetic interface assembly is shown, a two-piece assembly is also envisaged and will be presented below.

In more generality, the invention can be described as a method for supplying data and/or power to a mobile device from a host device. The method can be described as having several steps. The first step involves fitting a smart device with a first "plug-in" body part with first face having a low aspect ratio that seats close to the outside housing of the device. A second step involves bringing a magnetic face of a second body part with second face into magnetic proximity with an exposed face of the first body part so that the two faces magnetically "snap" together and form an electrical contact for transmitting data or data and power across the interface. The method also involves transmitting data or data and power to (or to and from) the mobile device from (or to) a host device. In a first variant of the method, rotating the first body part 0 degrees or 180 degrees on a long axis perpendicular to the first face achieves an equivalent circuit for transmitting data or data and power. In a second variant of the method, rotating the second body part (or the cable) 0 degrees or 180 degrees on a long axis perpendicular to the first face achieves an equivalent circuit for transmitting data or data and power.

In another aspect, the inventive method includes a step for providing a quick connect coupling having a first plug-in body part with first face and a second body part with second face; a) wherein the first plug-in body part comprises a plug-in end and an opposite end, the plug-in end having leads adapted to be connectedly received by an I/O and power port of a guest device and the opposite end comprising a magnetically responsive member, the opposite end further comprising a plurality of pads electrically connected to the leads; b) a second body part comprising a first end and a second end, the first end including: i) a pin connector head having a plurality of pins configured to make an electrical connection with the plurality of pads when contacted thereto; ii) a magnetic toroid configured to seat around the pin connector head, wherein the magnetic toroid and the magnetically responsive element are configured to exert a coupling force between the first face and the second face in either of two rotational orientations; a first rotational orientation wherein the first face and the second face are interfacedly mated at a zero rotation and a second rotational orientation wherein the first face and the second face are mated at a one-hundred-eighty degree rotation to each other, in both rotational orientations forming an electrical interface with a magnetic coupling; and, c) the second end having a plurality of electrical connections between the pin connector head and a cable, wherein the electrical connections are configured to convey data or a combination of data and power in one direction or bidirectionally through the interface between the mobile device and the host device when the electrical interface is established in either of the two rotational orientations.

Figure 18C:
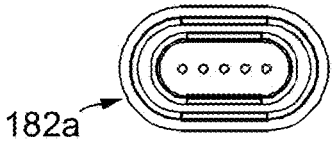
FIGS. 18C and 18D are the mating magnetic interface ends of a first body part and a USB end of the cable, respectively.
Figure 18D:
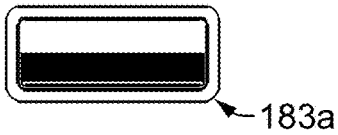
Figure 18A:
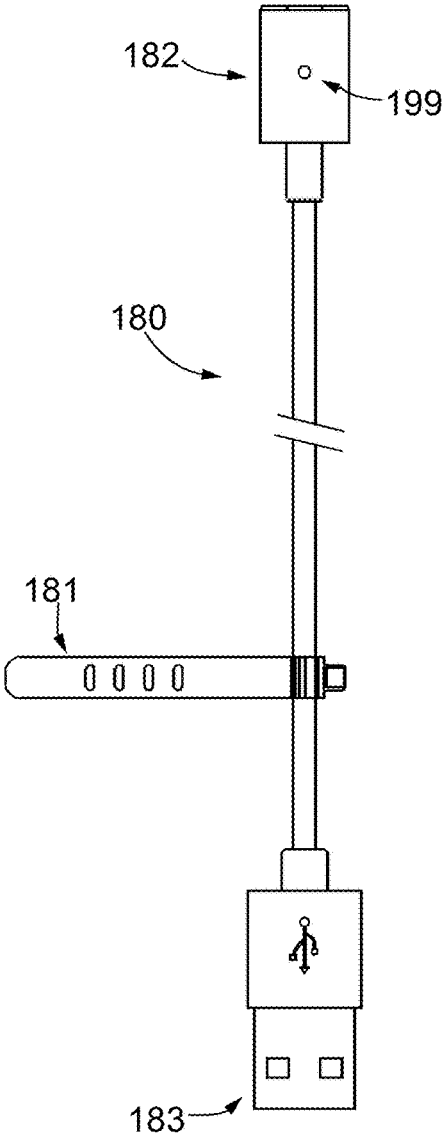
FIGS. 18A and 18B illustrate a dedicated cable configured to interconnect a USB power and data supply with a mobile device (not shown) having a magnetic interconnect second plug-in body part.
Figure 18B:
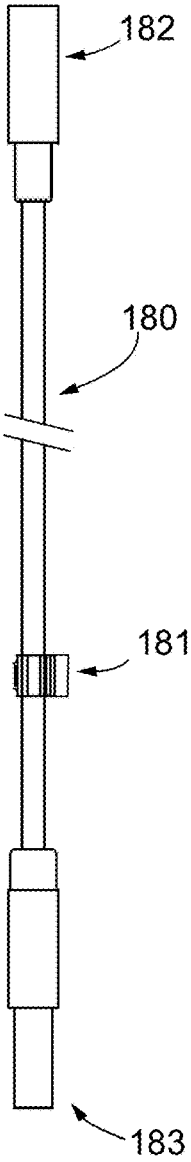

FIGS. 18A and 18B illustrate a dedicated cable 180 configured to interconnect a USB power and data supply with a mobile device (not shown) having a compatible second plug-in body part. The cable may be provided with a cable tie 181 so that it can readily be coiled and organized for storage and may be provided in one or more lengths according to user preferences and has two ends 182, 183. FIGS. 18C and 18D are the mating first body part interface end face 182*a* and the USB end face 183*a* of the cable, respectively. An LED 199 may be provided.

Figure 17A:
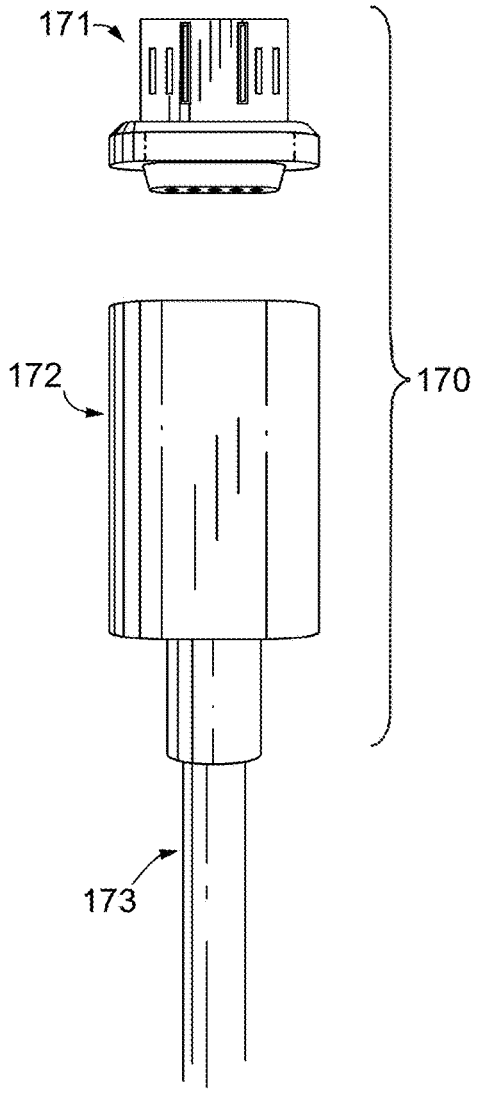
FIGS. 17A and 17B are renderings of two "species" of the inventive quick connect magnetic interface assembly.
Figure 17B:
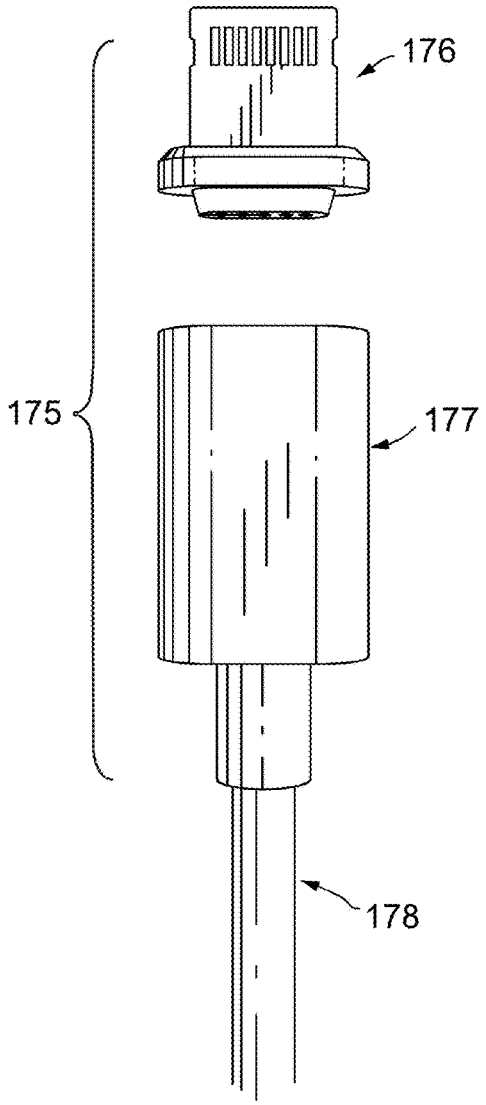

FIGS. 17A and 17B are renderings of a of "two-part" adaptor for two "species" of the inventive quick connect coupling (170, 175). FIG. 17A illustrates a THUNDERBOLT® coupling set 170 and FIG. 17B illustrates a LIGHTNING® coupling set 175. Other species of interfaces may also be provided based on this simple design, such as a USB interface, a third generation interface, a fourth generation interface, and so forth. Interfaces may include three, four, five, six, seven or more individual electrical connectors for conveying power and data. Interfaces with ten or more or twenty or more electrical connectors are also conceived. In FIGS. 17A and 17B the second body part (172,177) is a permanent endpiece on the cable (173,178), eliminating the loose middle piece (such as seen in FIG. 15) that could be misplaced or dropped. Now, the only step required to achieve an electrical data or power and data connection is to bring the two mating ends (171/172 or 176/172) into proximity so that they snap against each other as a result of the magnetic pull force.

Figure 19A:
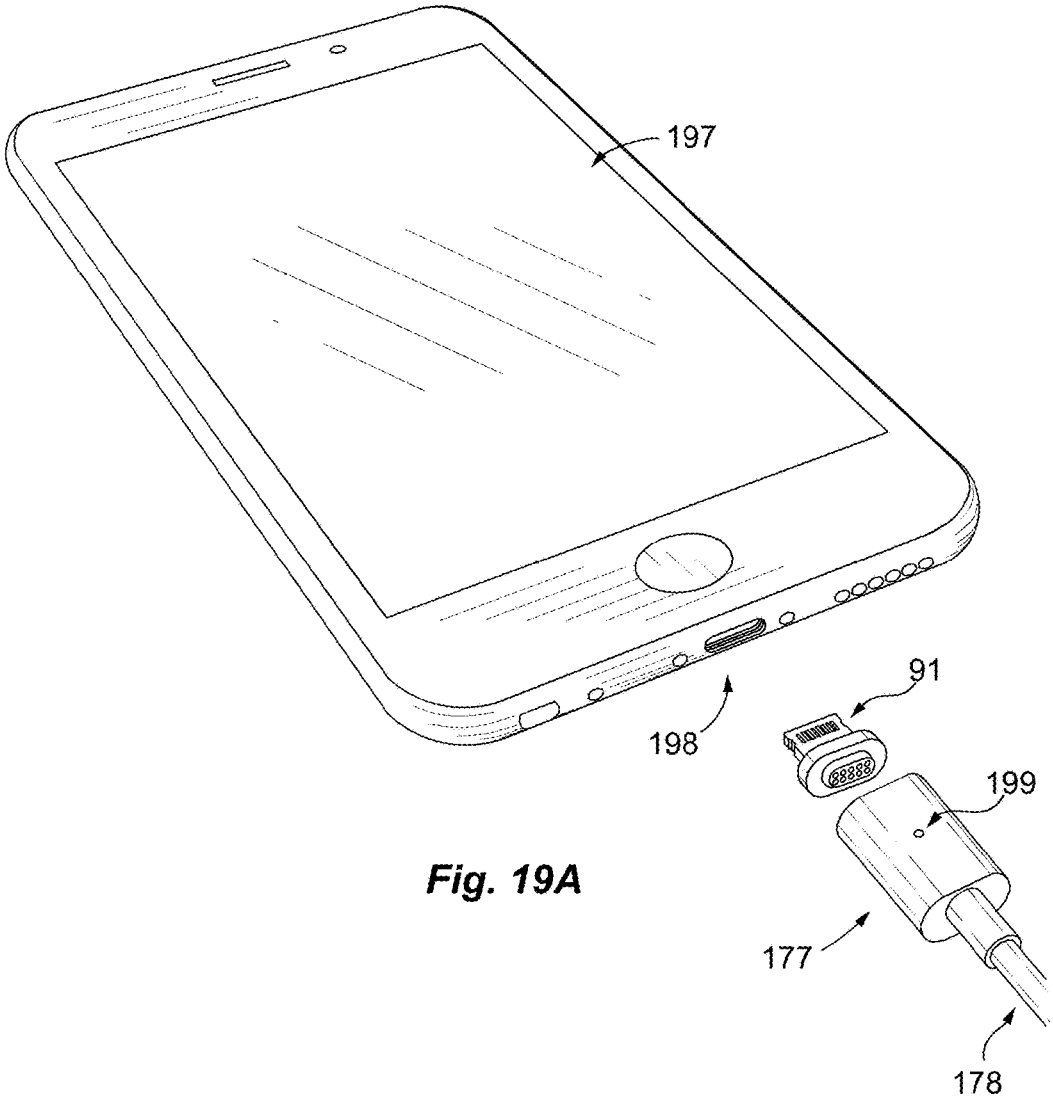
FIG. 19A is a view of a first plug-in body part and cable modified with a mating electrical coupling having a toroidal magnet element surrounding an array of pins.
Figure 19B:
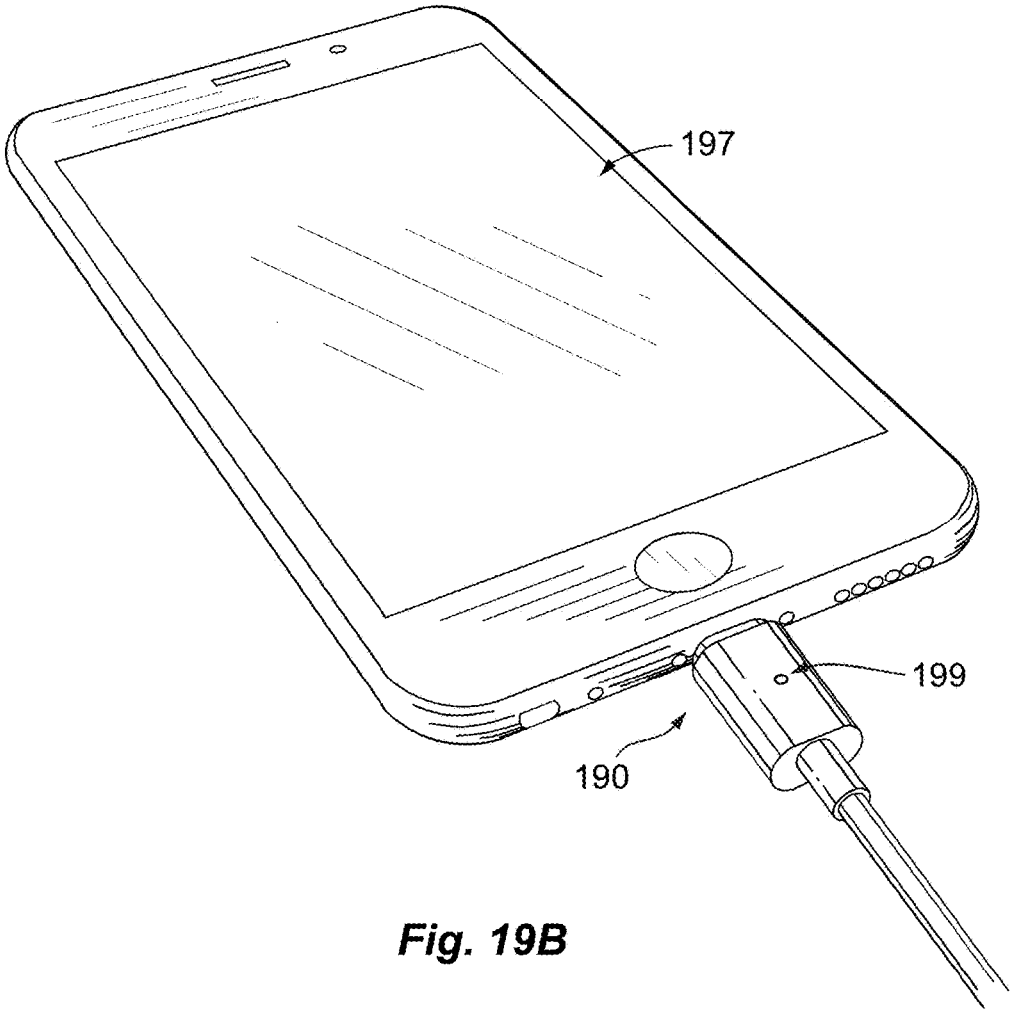
FIG. 19B shows the fully assembled quick magnetic coupling.

FIG. 19A is an exploded view of a first plug-in body part 91 and cable 178, in which the cable end is modified with a second body part end assembly 177 having a toroidal magnet element surrounding an array of pins. Here we see two rows of electrical pads on the first body part, each pad having a corresponding spring-loaded pin on the second body part interface. FIG. 19B shows the fully assembled magnetic interface coupling assembly 190 plugged into a smart device 197. The center light 199 is illuminated when the connection is made and goes off when the connection is broken. As a guest device, a smart phone 197 is illustrated, the smart phone having a power and I/O port 198. The coupling adaptor may be supplied as part of a two-piece kit (with integral cable).

Figure 19C:
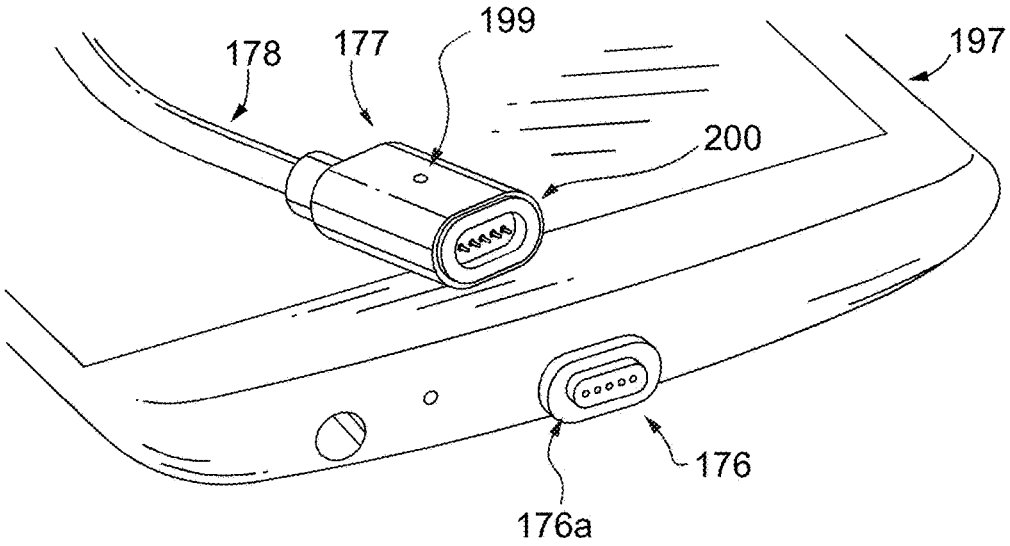
FIG. 19C is a perspective rendering of the two faces of the electrical interface with magnetic coupling.

FIG. 19C is a perspective rendering of the two faces a magnetic coupling with electrical interface. The first plug-in body part 176 is seated in its power and I/O port in the mobile device, here shown as a smart phone 197. The second body part 177 is integrated onto one end of a cable 178 and rests on top of the smart device. The exposed face of the second body part (with five pins) may be repositioned to magnetically engage the exposed distal face 176*a* of the first body part (with five pads). Typically the pins are gold or other conductive metal and are connected to wires in the cable. Typically the pads are wired to the plug-in connector (here a LIGHTNING® connector as seen in FIG. 19A) that engages I/O and recharging connections inside the mobile device.

A spring-mounted pin head connector PCB assembly inside a magnetic toroid 200 is taught in this disclosure. A pin head connector seated in the toroid is illustrated in FIG. 19C and the respective description. The assembly of the second body part, from distal to proximal relative to the terminal mobile device, includes a standard female connector or cable; a sleeve around the second body part for insulation; a soldered mount having pogo pins 201 (FIG. 20) on a printed circuit board, where each pogo pin or equivalent is a spring-mounted cylinder or hollow metal finger projecting from the second body part interface; a magnet in the form of a toroid that inserts over the head of the pin connector inside the sleeve, and a molded outer body or housing with open docking bay for receiving the first face of the first body part. Surprisingly, the pins and pads of the magnetic interface are aligned during manufacture by the dimensional tolerances of the magnetic toroid in the second body part and its mating magnetically responsive element in the first body part, and are aligned during use by the outside bevel on the first body part docking port and by the magnetic field, which together causes the two pieces to be self-aligning and permits the provider to design in an efficacious magnetic pull sufficient for a hard contact but easily broken to separate the pieces.

Figure 20:
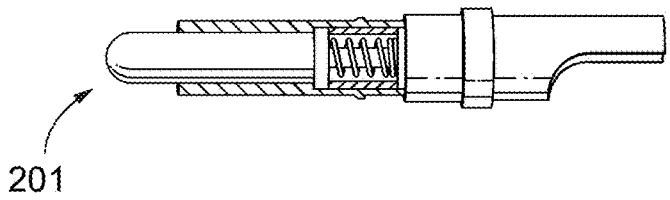
FIG. 20 illustrates a representative pin with spring mount.

A sample pin 201 is shown in FIG. 20. The spring activated pin is mounted as shown in FIG. 19C and is compressed when subjected to the magnetic pull force, ensuring a patent electrical connection. In this way the magnetic pull force and the spring push force are complementary, opposing each other to bring the pins and pads into solid contact.

The concept of the first body part (31,161,171,176) as optionally always resident in the portable device is clearly illustrated here. The first body part stays plugged into the device, even when the magnetic connection is broken. The concept of "interchangeably connectable electronics" permits hot swapping. Disconnecting the device from the second body part is easy as pulling the device away from the second body part, and reconnection is equally easy—the two parts of the magnetic interface seem to snap together on a guide wire provided by the beveled edges of the housing.

Figure 21:
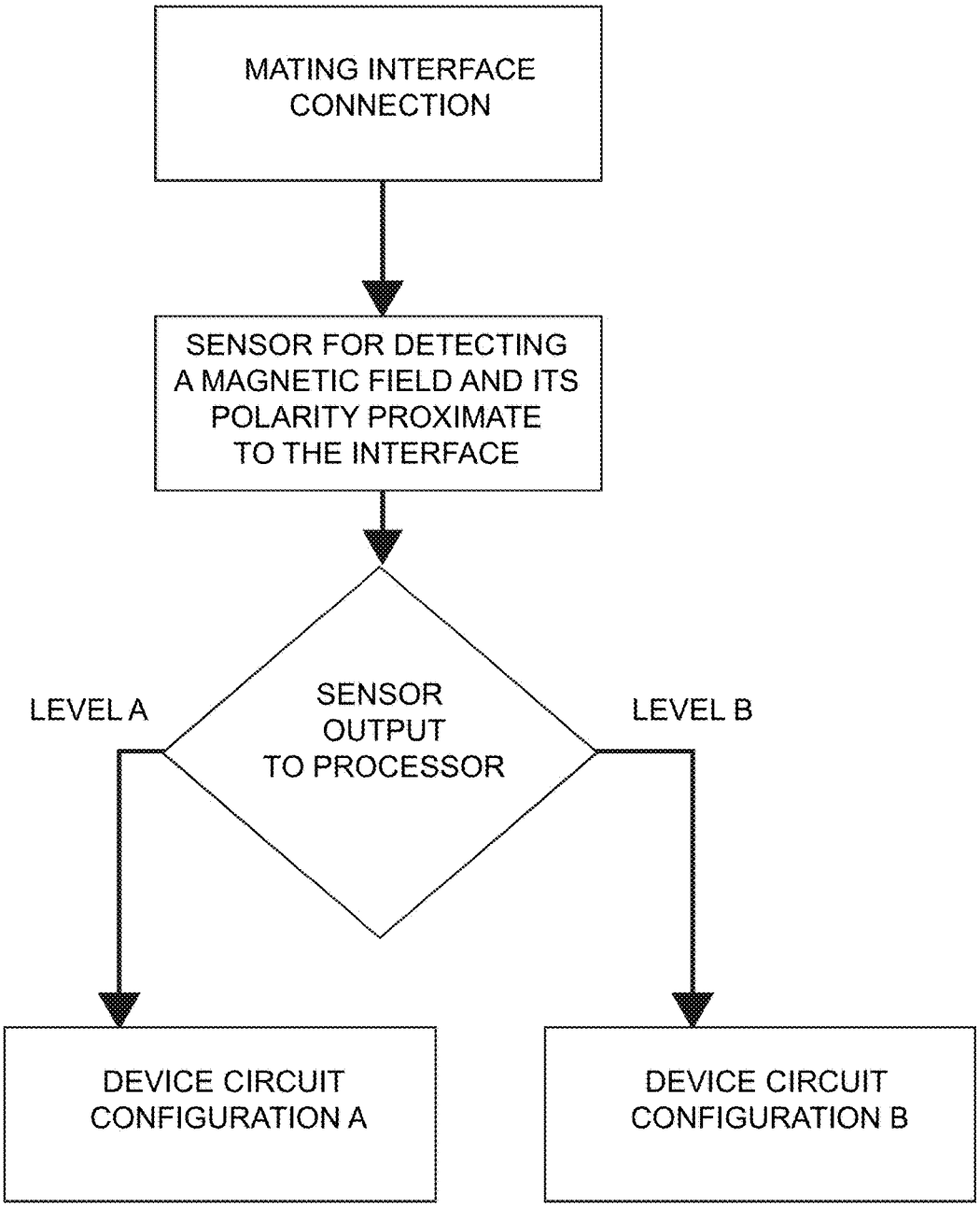
FIG. 21 is a flow chart of a device having logic capacity to detect a connection polarity according to a magnetic field and to configure circuitry within the device accordingly.

FIG. 21 is a flow chart of a device having a smart logic capacity to detect connection polarity according to a magnetic field in proximity thereto, and to configure circuitry within the device accordingly. Surprisingly, by using a magnetic sensor, any reconfiguration of internal circuitry to accept the connection may be made before an electrical connection is established, an advantage that prevents possible electrical damage and avoids the need for Schottky diodes and ESD devices to prevent short circuit damage due to transient current or voltage spikes during switching.

In this apparatus, a mating interface includes one body member having a sensor for determining the polarity of a magnetic field in a second body part of the interface as it moves into proximity. Typically the second body part contains a permanent magnet having north and south poles oriented according to the outside edges of the interface. The sensor in the first body part may be for example a Hall Effect transistor, and may report a signal that is indicative of the strength and the polarity of the approaching magnetic field. A processor, on receiving this signal, may configure gates and switches within the device circuitry so that the connector interface is fully compatible with the incoming device and any power or data circuits are fully functional regardless of the relative alignment or "handedness" of the connectors. In this way rotationally symmetrical electrical connectivity is achieved by reconfiguring the circuits according to the signal received from a smart sensor, not by relying on the user to align the connector interfaces. Thus the magnetic coupling has a dual function and synergy in providing an attraction force for engaging and disengaging the electrical connection and also for ensuring that the electrical connection is fully functional regardless of the directionality of the coupling hardware.

Figure 22:
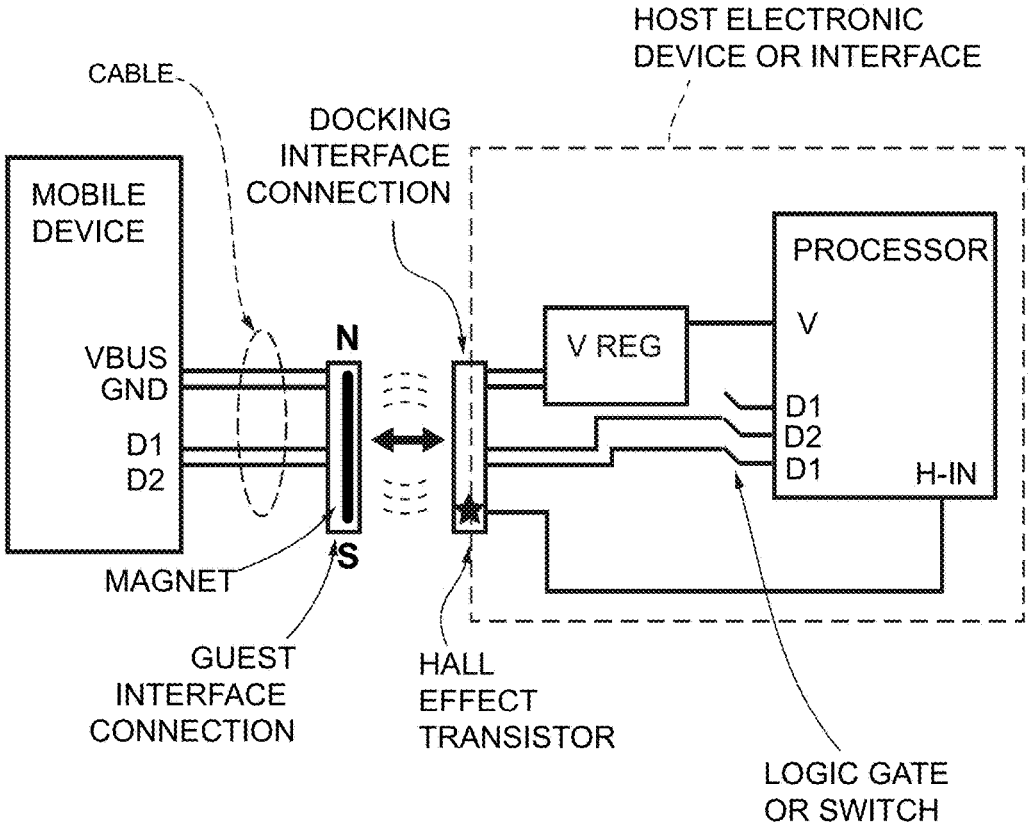
FIG. 22 is a circuit schematic for a "smart" magnetic interface assembly of the invention.

A schematic of a circuit of this type is shown in FIG. 22, where a "smart" charging adaptor of the invention also includes data transfer connections that may be configured using logic gates or switches under control of a microprocessor in an electronic device, module, or in an electronic interface such as docking bay or stand. The processor can communicate with the guest device through a cable, for example, using this interface. And can access flash memory and process audio or graphical data signals, to scan, transfer and open files, and so forth. Multiple data lines, such as in USB 3.0 connectors, may be reconfigured as needed for data transfer.

In this view, the cable connector is supplied with a permanent magnet having a north pole (N) and a south pole (S) and an associated magnetic flux. Magnetic flux lines are decoded by a Hall Effect transistor mounted in the interface, the polarity of the flux lines resulting in an output that is positive or negative depending on the orientation or handedness of the connector approaching the interface (double arrow).

The host electronic device or interface can include switches. The switches may be solid state or analog switches. Inputs of switches can be coupled with $V_{BUS}$ and GND, or can be coupled with data lines (D1, D2) as shown, where the data lines are enabled to transfer data to the host device through a cable from a guest USB device, for example. The inputs of a first switch can be coupled with data D1 and a second switch with data D2 such that the circuit is complete for one or the other or both of the data lines depending on logic resident in the processor. Switches can be in an open state by default and are closed on receipt of a signal from a smart sensor indicating approach of a device connector in proximity to the docking interface.

The host device may also include voltage regulator. The voltage regulator can be coupled to the outputs of a switch so that when the switch is closed, the output of the voltage regulator is connected to $V_{BUS}$. The voltage regulator can, for example, include circuitry operable to charge a battery in a mobile device from a power supply through the docking interface or quick connect coupling. In another embodiment, the voltage regulator can directly couple $V_{BUS}$ with a voltage rail or anode of a battery or fuel cell of the host device and GND with a common ground or chassis ground or to a cathode of a battery or fuel cell.

The host device can include a processor (also sometimes termed a "microprocessor" or "controller"). The processor can be coupled with the system clock. The processor can be capable of communicating over more than one interface such as a UART or a parallel data bus. The processor may have different input/output busses for communicating over different interfaces. The processor may be coupled to the outputs of switches as shown. The first outputs of one switch can be coupled to one bus the host processor that corresponds to a particular interface or pin on the processor (D1). The second outputs a second switch can be coupled to a second bus of the host processor that corresponds to a different interface or pin on the processor (D2). A switch can connect data with D1 or D2 in order to facilitate communication using the detected interface. The processor can proceed to communicate with the mobile device, for example, using this interface. The processor may also perform or direct other functions which are inherent to the host device. The processor for example can, for example, access flash memory and process audio or graphical data signals, to scan, transfer and open files, and so forth.

In this exemplary schematic, which is simplified for clarity, a Hall Effect sensor is shown (star). The emitter and collector circuitry is assumed as would be known to one skilled in the art. The Hall Effect sensor serves to detect the presence of a magnetic field at a preset level of sensitivity and is also configurable to detect the polarity of the field and to respond by varying its output accordingly. The output may be directed to the processor or to an accessory circuit, and logical operations that are software or firmware based may be executed to reconfigure switches and/or logic gates accordingly so as to prepare the host device for docking of the mobile device shown in this example.

Hall effect sensors having sensitivity to fields of 100 Gauss or more are well known. A ratiometric Hall effect sensor outputs an analog voltage proportional to the magnetic field intensity. Preferred devices are unipolar and in general the output is one-half the supply voltage in the absence of an applied magnetic field. However, the voltage will increase with the south magnetic pole on the face or decrease with the north magnetic pole on the face, for example. Paired unipolar devices or bipolar devices may also be used to detect the magnetic field proximity and polarity of a connection interface fitted with a permanent magnet of a magnetic coupling of the invention. Integrated circuits or Schmidt triggers may be used to convert the output to a digital "on-off" signal for power switching, for example, and if necessary pre-amplifying the output using solid state circuitry that is readily miniaturized.

Once the host device selects which communication interface is going to use, an interface controller may be directed to begin operations of receiving and transmitting data. It is contemplated that interface controllers can be powered off by default, and the appropriate controller can be turned on by a signal directly from the sensor or from the processor. Once connected, the appropriate interface controller can initialize communications with an external device. What this means is that, an interface controller may take certain steps, commonly called a "handshake" procedure, to begin communications between two devices across the interface. These handshake procedures can be different for each type of interface.

These and other embodiments enable a chip in an electronic device or docking bay to switch circuitry so as to receive an external connection and make appropriate electrical connections independent of the orientation of the connector. Operations on completion of docking may be automatically executed by the processor or may be under control of a user interface in either the host or the mobile device.

Multiple data lines, such as in USB 3.0 connectors, may be reconfigured as needed. Power supplies may also be reconfigured. These and other features of the invention are a technical advance in the field and permit the user to establish an electrical connection without requiring the user to inspect the connector and verify proper insertion.

Use of magnetic interfaces for electrical contacts also permits reduced width or depth of body members, (including sockets, pins, and connectors) needed to support an electrical connection, promoting the trend toward increased miniaturization and convenience.

In more generality, the smart connector embodiment of a magnetic interface coupling assembly may be described as having:

(a) an electrical connector having two mating parts, the two parts including a first electrical assembly with first connector interface surface and a second electrical assembly with second connector interface surface, wherein the first electrical assembly is enabled to be electrically connected to the second electrical assembly at the interface surfaces thereof, further wherein the electrical connector interface surfaces mate in a first rotational orientation and a second rotational orientation defined by a positive or negative 180 degree rotation of the parts on the long axis of the adaptor, and wherein the long axis is perpendicular to the interface surfaces;

(b) a magnet proximate to the first connector interface surface and a magnetically responsive element proximate to the second connector interface surface, wherein the magnet is enabled to operatively secure the first electrical assembly to the second electrical assembly by a magnetic attraction when contacted thereto, and further wherein the magnet defines a magnetic field having a polarity wherein the first rotational orientation and the second rotational orientation are distinguished by the orientation of the north and south poles of the magnet as aligned thereto;

(c) a circuit element in the second electrical assembly, wherein the circuit element is configured to detect the polarity of the magnetic field and output a signal to a processor operatively connected to a circuit in the second electrical assembly, the circuit having switches or logic gates for mating the parts so that the first and second connector interface surfaces establish a plurality of electrical connections therebetween when contacted thereto, the plurality of electrical connections being configured by the processor according to the polarity of the magnetic field as detected by the circuit element when in proximity to the magnet. In a preferred embodiment, the magnet and the magnetically responsive element operate as a magnetic coupling that secures and electrically connects the first interface surface to the second interface surface so that the two devices are smoothly mated and electrically connected with a tap and smoothly disengaged with a gentle tug. The permanent magnet and the magnetically responsive element are both preferredly toroidal in shape to aid in inserting the circuit boards and to ensure a higher level of stability when joined. The plurality of electrical connections are configured for sharing power and data under control of the processor, relieving the user of the need to correctly align the connector. Several configurations are possible. In one, the processor is resident in a guest device and the first electrical assembly is operatively joined to a host device. In another, the processor is resident in a host device and the first electrical assembly is operatively joined to a guest device. Also claimed are cables having quick connect couplings wherein the first electrical assembly is mounted on a host device, and the second electrical assembly is mounted endwise on the cable. Or the first electrical assembly is mounted on a guest device, and the second electrical assembly is mounted endwise on the cable.

The above disclosure is sufficient to enable one of ordinary skill in the art to practice the invention, and provides the best mode of practicing the invention presently contemplated by the inventor. While above is a complete description of the preferred embodiments of the present invention, various alternatives, modifications and equivalents are possible. These embodiments, alternatives, modifications and equivalents may be combined to provide further embodiments of the present invention. Further, all foreign and/or domestic publications, patents, and patent applications cited herein, whether supra or infra, are hereby incorporated by reference in their entirety for all they teach. The inventions, examples, and embodiments described herein are not limited to particularly exemplified materials, methods, and/or structures. Various modifications, alternative constructions, changes and equivalents will readily occur to those skilled in the art and may be employed, as suitable, without departing from the true spirit and scope of the invention. Therefore, the above description and illustrations should not be construed as limiting the scope of the invention, which is defined by the appended claims. It should be understood that different aspects of the invention can be appreciated individually, collectively, or in one or more combinations with each other

INCORPORATION BY REFERENCE

All of the U.S. patents, U.S. patent application publications, U.S. patent applications, foreign patents, foreign patent applications and non-patent publications referred to in this specification and related filings are incorporated herein by reference in their entirety. All publications, patent applications, patents, and other references mentioned herein are incorporated by reference in their entirety to the extent allowed by applicable law and regulations.

SCOPE OF CLAIMS

Having described the invention with reference to the exemplary embodiments, it is to be understood that it is not intended that any limitations or elements describing the exemplary embodiments set forth herein are to be incorporated into the meanings of the patent claims unless such limitations or elements are explicitly listed in the claims. Likewise, it is to be understood that it is not necessary to meet any or all of the identified advantages or objects of the invention disclose herein in order to fall within the scope of any claims, since the invention is defined by the claims and inherent and/or unforeseen advantages of the present invention may exist even though they may not be explicitly discussed herein.

While the above is a complete description of selected, currently preferred embodiments of the present invention, it is possible to practice the invention use various alternatives, modifications, combinations and equivalents. In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

REFERENCE NUMBERS OF THE DRAWINGS

20 quick connect magnetic interface assembly
21 first body part
22 second body part
24 proximal connector end
24*a* proximal end plug in connector
24*b* THUNDERBOLT plug-in connector
25 distal connector end
31 distal end connector body of first body part
32 first body part outer body housing
33 printed circuit board of first body part
34 insulating overlayer
35 magnetically responsive element
35*a* docking bay
36 second body part outer housing
37 magnetic toroid
38 pin-connector head assembly
39 insulative sleeve
40 female cable connector receptacle
41 representative pin
42 representative pad
60 schematic of magnetic interface
61 ground
62 hot
80 alternate first body part
82 alternate second body part
83 pin array with two rows of pins
83*a* representative pin
91 LIGHTNING male plug in end
92 alternate first body part
92*a* pad array
100 alternate first body part
101 male plug in end
102 distal face
102*a* pad array
110 Alternate first body part
111 male plug in end
112 distal face of first body part
113 pad support
113*a* bevel on pad support
114 magnetically responsive element
115 alternate first body part
116 magnetically responsive element
117 pad support
117*a* bevel on pad support
118 distal face of first body part
119 male plug in end
120 second body part
121 distal face of second body part
122 proximal face of second body part
130 first body part
131 representative pad
132 second body part
133 cable
134 cable end connector assembly
135 representative pin
140 junction
141 pin layout on magnetic interface
150 three-part quick coupling adaptor
151 first body part
152 second body part
153 cable end connector
160 three-piece magnetic coupling
161 first body part
162 second body part
163 cable end with plug in
164 union of second body part and cable
170 Android species of two-part magnetic coupling
171 first body part
172 second body part with attached cable
173 cable
175 Lightning species of two-part magnetic coupling
176 first body part
176*a* distal face of first body part
177 second body part with attached cable
178 cable
180 cable
181 cable tie
182 proximal end piece
182*a* proximal end face
183 distal end piece
183*a* distal end face
190 magnetic coupling with fully operational electrical coupling
197 smart phone
200 magnetic toroid
201 representative pogo pin

I claim:

1. A quick connect adaptor and cable combination for electrically connecting a first digital device to a second digital device, which comprises a) a first body part having a proximal end and a distal end, said proximal end of said first body part comprising a proximal connector surface with power and data circuit leads connectably insertable into a receptacle in a guest device, and said distal end of said first body part comprising a magnetically responsive member and a plurality of pads electrically connected to said circuit leads;

b) a second body part having a proximal end and a distal end, said proximal end of said second body part comprising:

i) a pin connector head having a plurality of pins configured to each make electrical connections with said plurality of pads when contacted thereto, said electrical connections defining an electrical interface;

ii) a magnetic element configured to seat around said pin connector head, wherein said magnetic element and said magnetically responsive element are configured to exert a hot swappable coupling force between said distal end of said first body part and said proximal end of said second body part;

c) said distal end of said second body part having i) an integral cable or a cable receptacle configured to receive a cable, wherein said cable is configured to make an electrical connection to a host device;

ii) a plurality of electrical connections between said pin connector head and said cable or cable receptacle; and, wherein said two body parts define an adaptor, and further wherein said adaptor in combination with said cable is configured to convey data or a combination of data and power between said guest device and said host device when said first body part is magnetically coupled to said second body part.

2. The quick connect adaptor of claim 1, wherein said coupling force comprises a magnetic pull force between said magnetic element and said magnetically responsive element opposed by a spring force between said array of pads and said array of pins, each said pin having a spring bias against said pads when magnetically coupled thereto.

3. The quick connect adaptor of claim 1, wherein said pin connector head with plurality of pins is configured to make electrical connections with said plurality of pads when contacted thereto in either of two rotational orientations, wherein said two rotational orientations are defined by a 180 degree rotation of said proximal end of said second body part relative to said distal end of said first body part.

4. The quick connect adaptor of claim 1, wherein said distal end of said first body part comprises four or more pads and said proximal end of said second body part comprises four or more pins, such that said pins are configured to electrically contact said pads.

5. The quick connect adaptor of claim 1, wherein said electrical interface is configured for sharing digital data.

6. The quick connect adaptor of claim 5, wherein said distal end of said first body part comprises at least five said electrical pads and said proximal end of said second body part comprises at least five said pins configured to form an electrical connection with said pads when contacted.

7. The quick connect adaptor of claim 1, wherein said magnetic element comprises a permanent magnet.

8. The quick connect adaptor of claim 1, wherein said first body part is configured to be semi-permanently mounted in a data or data and power receiving port of any one of a plurality of portable electronic devices; and said cable is configured to be interchangeably connectable to a host device.

9. The quick connect adaptor of claim 8, wherein said portable electronic devices are selected from a cell phone, a memory stick, a computer, a laptop, a camera, a DVD player, a recorder, or a plurality thereof.

10. The quick connect adaptor of claim 1, wherein said cable is configured to be interchangeably hot swappable between a first guest device for a second guest device.

11. The quick connect adaptor of claim 1, wherein said first body part of said adaptor is provided in a plurality of configurations so as to be connectable to a plurality of portable electronic devices.

12. A method for exchanging data or a combination of data and power between a host device and a remote device, which comprises:

a) fitting a smart device with a first plug-in body part with first face having a low aspect ratio that seats close to the outside housing of the device; wherein said first plug-in body part comprises a proximal end and a distal end, said proximal end of said first body part comprising a proximal connector surface with power and data circuit leads connectably insertable into a receptacle in a guest device and said distal end comprising a magnetically responsive member, said distal end comprising a distal face with a plurality of pads electrically connected to said circuit leads;

b) providing a second body part comprising a proximal end and a distal end, said proximal end comprising: i) a proximal face comprising a pin connector head having a plurality of pins configured to make electrical connections with said plurality of pads when contacted thereto; ii) a magnetic element configured to seat around said pin connector head, wherein said magnetic element and said magnetically responsive element are configured to exert a coupling force between said distal face of said first body part and said proximal face of said second body part, said distal end of said second body part having a plurality of electrical connections between said pin connector head and a cable, wherein said electrical connections are configured to convey data or a combination of data and power between a remote device and a host device when said when said first body part is magnetically coupled to said second body part;

c) Bringing said proximal face of said second body part into magnetic proximity with said distal face of the first body part so that said two faces snap together and form an electrical interface for transmitting data or data and power across said interface; and, d) transmitting data or data and power across said interface between the host device and the remote device.

13. The method of claim 12, further comprising rotating the first body part zero degrees or one-hundred-eighty degrees on a long axis perpendicular to the first face when forming said electrical interface.

14. The method of claim 12, further comprising rotating the second body part zero degrees or one-hundred-eighty degrees on a long axis perpendicular to the first face when forming said electrical interface.

15. The method of claim 12, further comprising hot swapping a first remote device for a second remote device.

16. A quick connect adaptor for electrically connecting a guest device to a host device, which comprises (a) an electrical connector having two mating parts, said two parts including a first electrical assembly with first connector interface surface and a second electrical assembly with second connector interface surface, wherein said first electrical assembly is enabled to be electrically connected to said second electrical assembly at said interface surfaces thereof, further wherein said electrical connector interface surfaces mate in a first rotational orientation and a second rotational orientation defined by a positive or negative 180 degree rotation of the parts on the long axis of the adaptor, and wherein the long axis is perpendicular to the interface surfaces;

(b) a magnet proximate to said first connector interface surface and a magnetically responsive element proximate to said second connector interface surface, wherein said magnet is enabled to operatively secure said first electrical assembly to said second electrical assembly by a magnetic attraction when contacted thereto, and further wherein said magnet defines a magnetic field having a polarity wherein said first rotational orientation and said second rotational orientation are distinguished by the orientation of the north and south poles of the magnet as aligned thereto;

(c) a circuit element in said second electrical assembly, wherein said circuit element is configured to detect the polarity of the magnetic field and output a signal to a processor operatively connected to a circuit in said second electrical assembly, said circuit having switches or logic gates for mating said parts so that said first and second connector interface surfaces establish a plurality of electrical connections therebetween when contacted thereto, said plurality of electrical connections being configured by said processor according to said polarity of said magnetic field as detected by said circuit element when in proximity to said magnet; and, (d) further wherein said first electrical assembly is electrically connectable to a guest device and said second electrical assembly is electrically connectable to a host device.

17. The quick connect adaptor of claim 16, wherein said magnet and said magnetically responsive element operate as a magnetic coupling that secures and electrically connects the first interface surface to the second interface surface so that the two devices are smoothly mated and electrically connectable with a tap and smoothly disengageable with a gentle tug.

18. The quick connect adaptor of claim 16, wherein said plurality of electrical connections are configured for sharing power and data under control of said processor.

19. The quick connect adaptor of claim 16, further comprising a cable, wherein said cable is electrically connected or connectable to said second connector interface surface.

* * * * *